US007726880B2

(12) United States Patent
Zimmerman et al.

(10) Patent No.: US 7,726,880 B2
(45) Date of Patent: Jun. 1, 2010

(54) FLEXIBLE STORAGE BAG

(75) Inventors: Dean Arthur Zimmerman, West Chester, OH (US); Carl Louis Bergman, Loveland, OH (US); Chinto Benjamin Gaw, Cincinnati, OH (US); Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 870 days.

(21) Appl. No.: 10/880,784

(22) Filed: Jun. 29, 2004

(65) Prior Publication Data

US 2005/0286808 A1 Dec. 29, 2005

(51) Int. Cl.
*B65D 33/01* (2006.01)

(52) U.S. Cl. ..... 383/103; 383/100; 383/44; 53/405

(58) Field of Classification Search ..... 383/100, 383/103, 63, 44; 53/405
See application file for complete search history.

(56) References Cited

U.S. PATENT DOCUMENTS

| | | | | |
|---|---|---|---|---|
| 2,142,970 | A | 1/1939 | Anderson | |
| 2,576,322 | A | 11/1951 | Waters | |
| 2,649,234 | A * | 8/1953 | Taunton | 53/405 |
| 2,778,171 | A | 1/1957 | Taunton | |
| 2,778,173 | A * | 1/1957 | Taunton | 53/427 |
| 2,870,954 | A | 1/1959 | Kulesza | |
| 2,913,030 | A | 11/1959 | Fisher | |
| 2,927,722 | A | 3/1960 | Metzger | |
| 2,946,502 | A | 7/1960 | Metzger | |
| 3,054,551 | A | 9/1962 | Holbrook | |
| 3,224,574 | A | 12/1965 | McConnell | |
| 3,949,934 | A | 4/1976 | Goglio | |
| 3,980,226 | A | 9/1976 | Franz | |
| RE30,045 | E | 7/1979 | Greene | |

(Continued)

FOREIGN PATENT DOCUMENTS

| | | |
|---|---|---|
| JP | 3212355 A | 9/1991 |

(Continued)

OTHER PUBLICATIONS

International Search Report for PCT Application No. PCT/US05/22309, which claims priority to U.S. Appl. No. 10/880,784, Jun. 29, 2004.

*Primary Examiner*—Nathan J Newhouse
*Assistant Examiner*—Jack H Morgan, Jr.
(74) *Attorney, Agent, or Firm*—Thomas C. Feix

(57) ABSTRACT

The flexible storage bag includes overlaying first and second sidewalls defining an internal volume that can be accessed from an open top edge. To evacuate air from the internal volume after the open top edge has been closed, the bag includes a one-way valve element attached to the first sidewall and communicating with the internal volume. To prevent the one-way valve element from becoming clogged by the opposing second sidewall, the bag also includes a clearance member that maintains at least a partial clearance between the first and second sidewalls proximate the valve element. The clearance member can take many forms such as a textured portion on the second sidewall that includes evacuation passages which provide air in the internal volume access to the valve element, a permeable element covering the valve element, and a rigid or compressible structure that spaces the second sidewall from the valve element.

6 Claims, 23 Drawing Sheets

U.S. PATENT DOCUMENTS

| | | | | |
|---|---|---|---|---|
| 4,295,566 | A | 10/1981 | Vincek | |
| 4,310,118 | A * | 1/1982 | Kisida et al. | 383/102 |
| 4,601,410 | A | 7/1986 | Bond | |
| 4,653,661 | A | 3/1987 | Buchner et al. | |
| 4,702,376 | A | 10/1987 | Pagliaro | |
| 4,715,494 | A | 12/1987 | Heitzenrioder et al. | |
| 4,756,422 | A | 7/1988 | Kristen | |
| 5,059,036 | A | 10/1991 | Richison | |
| 5,228,271 | A | 7/1993 | Wallace | |
| 5,240,112 | A | 8/1993 | Newburger | |
| 5,246,114 | A | 9/1993 | Underwood | |
| 5,332,095 | A | 7/1994 | Wu | |
| 5,333,736 | A | 8/1994 | Kawamura | |
| 5,388,910 | A | 2/1995 | Koyanagi | |
| RE34,929 | E | 5/1995 | Kristen | |
| 5,450,963 | A * | 9/1995 | Carson | 206/524.8 |
| 5,480,030 | A * | 1/1996 | Sweeney et al. | 206/524.8 |
| 5,540,500 | A | 7/1996 | Tanaka | |
| 5,544,752 | A | 8/1996 | Cox | |
| 5,584,409 | A | 12/1996 | Chemberlen | |
| 5,881,881 | A | 3/1999 | Carrington | |
| 5,931,189 | A * | 8/1999 | Sweeney et al. | 137/512.15 |
| 5,954,196 | A | 9/1999 | Lin | |
| 5,989,608 | A | 11/1999 | Mizuno | |
| 5,996,800 | A | 12/1999 | Pratt | |
| 6,021,624 | A | 2/2000 | Richison et al. | |
| 6,039,182 | A | 3/2000 | Light | |
| 6,059,457 | A | 5/2000 | Sprehe et al. | |
| 6,070,397 | A | 6/2000 | Bachhuber | |
| 6,070,728 | A | 6/2000 | Overby | |
| 6,085,906 | A | 7/2000 | Lambert | |
| 6,116,781 | A | 9/2000 | Skeens | |
| 6,277,547 | B1 | 8/2001 | Bourdelais | |
| 6,357,915 | B2 | 3/2002 | Anderson | |
| 6,408,872 | B1 | 6/2002 | Skeens | |
| 6,575,191 | B2 | 6/2003 | Skeens et al. | |
| 6,581,641 | B2 | 6/2003 | Skeens et al. | |
| 6,604,634 | B2 | 8/2003 | Su | |
| 6,607,097 | B2 | 8/2003 | Savage | |
| 6,662,827 | B1 | 12/2003 | Clougherty et al. | |
| 6,715,644 | B2 | 4/2004 | Wilford | |
| 6,729,473 | B2 | 5/2004 | Anderson | |
| 6,799,680 | B2 | 10/2004 | Mak | |
| 6,814,991 | B2 | 11/2004 | Hiyoshi | |
| 6,837,268 | B2 | 1/2005 | Skeens | |
| 6,883,665 | B1 | 4/2005 | Ahn | |
| 6,983,845 | B2 | 1/2006 | Shah | |
| 6,991,109 | B1 | 1/2006 | Shannon | |
| 7,022,058 | B2 | 4/2006 | Lee | |
| 7,137,738 | B2 | 11/2006 | Shah | |
| 2003/0024847 | A1 | 2/2003 | Malaspina | |
| 2003/0035597 | A1 | 2/2003 | Buckingham et al. | |
| 2003/0037519 | A1 | 2/2003 | Ishizaki | |
| 2003/0102245 | A1 * | 6/2003 | Wang | 206/524.8 |
| 2003/0136798 | A1 * | 7/2003 | Wilford | 222/107 |
| 2003/0155269 | A1 | 8/2003 | Lee | |
| 2004/0000501 | A1 | 1/2004 | Shah et al. | |
| 2004/0000502 | A1 | 1/2004 | Shah et al. | |
| 2004/0000503 | A1 | 1/2004 | Shah et al. | |
| 2004/0007494 | A1 | 1/2004 | Popeil et al. | |
| 2004/0050745 | A1 * | 3/2004 | Lee et al. | 206/524.8 |
| 2004/0057636 | A1 | 3/2004 | Ishizaki | |
| 2004/0114837 | A1 | 6/2004 | Koyanagi | |
| 2004/0161178 | A1 | 8/2004 | Olechowski | |
| 2005/0025396 | A1 | 2/2005 | ErkenBrack | |
| 2005/0034806 | A1 | 2/2005 | Wu et al. | |
| 2005/0036717 | A1 | 2/2005 | Wu | |
| 2005/0036718 | A1 | 2/2005 | Wu et al. | |
| 2005/0036719 | A1 | 2/2005 | Wu | |
| 2005/0037163 | A1 | 2/2005 | Wu | |
| 2005/0037164 | A1 | 2/2005 | Wu | |
| 2005/0065007 | A1 | 3/2005 | Wu et al. | |
| 2005/0143243 | A1 | 6/2005 | Lee | |
| 2005/0147330 | A1 | 7/2005 | Lee | |
| 2005/0147774 | A1 | 7/2005 | Lee | |
| 2005/0172577 | A1 | 8/2005 | Oltrogge | |
| 2005/0178691 | A1 | 8/2005 | Frenkil | |
| 2005/0205455 | A1 | 9/2005 | Harrison | |
| 2005/0220373 | A1 | 10/2005 | Wu | |
| 2005/0220942 | A1 | 10/2005 | Wu | |
| 2005/0244083 | A1 | 11/2005 | McMahon | |
| 2005/0286808 | A1 | 12/2005 | Zimmerman | |
| 2006/0030472 | A1 | 2/2006 | Hartman | |

FOREIGN PATENT DOCUMENTS

| | | | |
|---|---|---|---|
| JP | 4242544 | A | 8/1992 |
| JP | 8198274 | A | 8/1996 |
| JP | 8301358 | A | 11/1996 |
| JP | 10139050 | A | 5/1998 |
| JP | 2000118540 | A | 4/2000 |
| JP | 2006082872 | A | 3/2006 |
| WO | WO9413556 | A1 | 6/1994 |
| WO | WO9833717 | A1 | 8/1998 |
| WO | WO0246044 | A1 | 6/2002 |
| WO | WO2004/002840 | | 1/2004 |
| WO | WO2004/002841 | | 1/2004 |
| WO | WO 2005/000706 | | 1/2005 |
| WO | WO2005002976 | A1 | 1/2005 |
| WO | WO 2005/016774 | | 2/2005 |
| WO | WO2005012107 | A1 | 2/2005 |
| WO | WO2005016774 | A1 | 2/2005 |
| WO | WO 2005/040005 | | 5/2005 |
| WO | WO2005040005 | A1 | 5/2005 |

* cited by examiner

FIG. 2
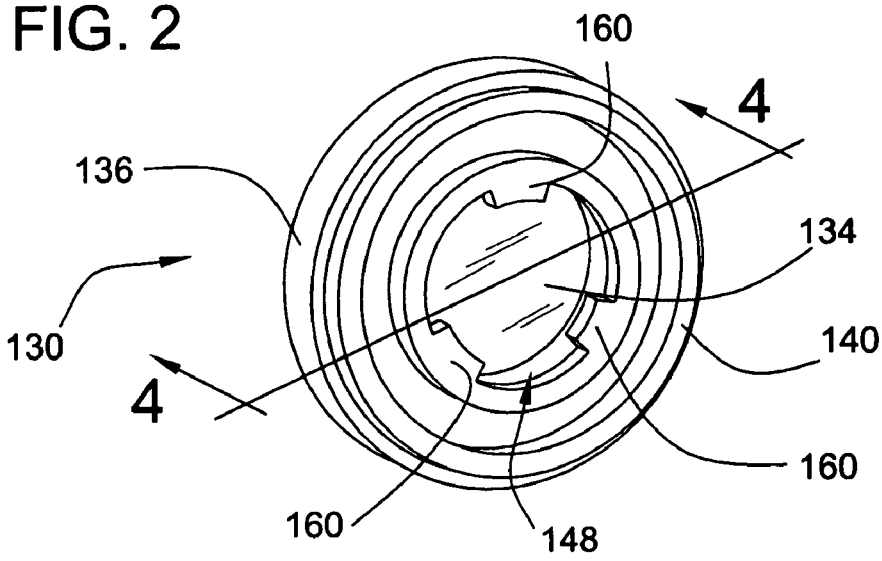
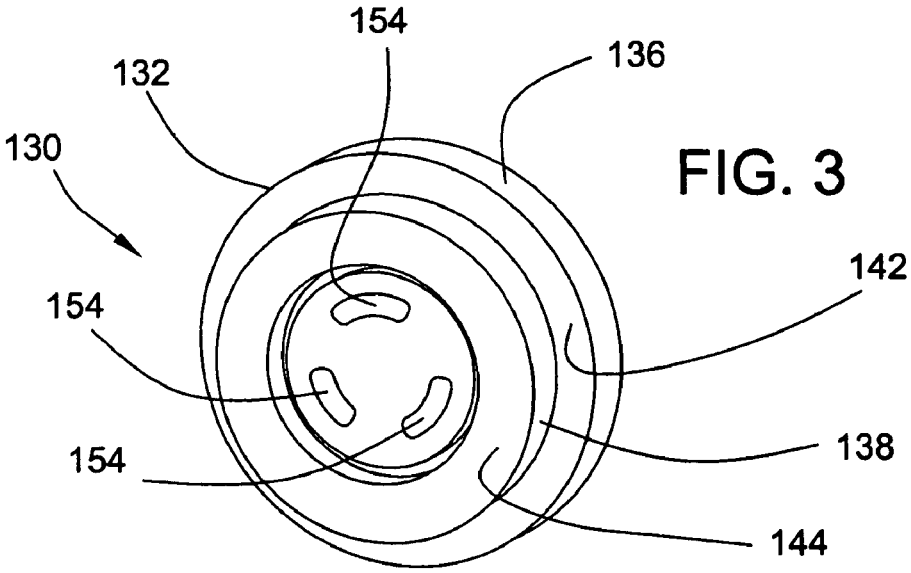
FIG. 3
FIG. 4
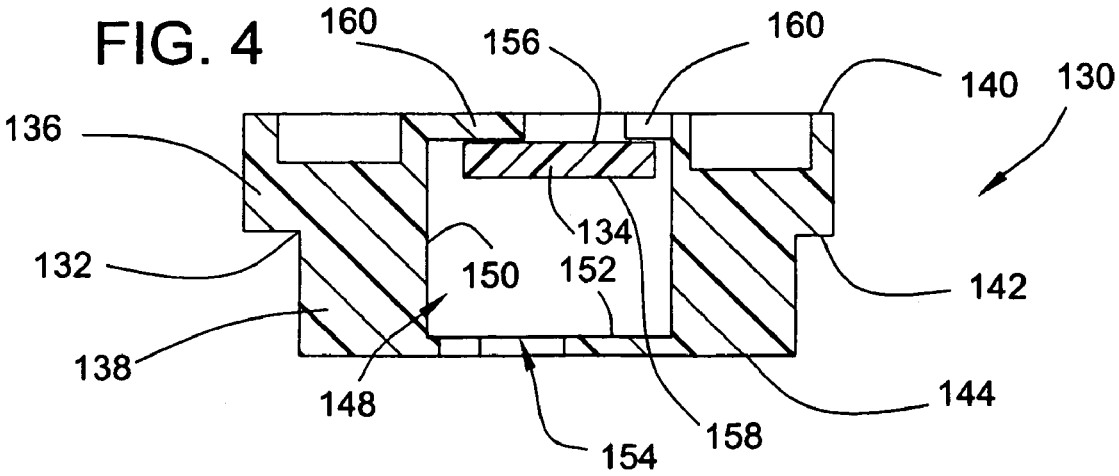

FLEXIBLE STORAGE BAG

FIELD OF THE INVENTION

This invention pertains generally to storage containers and more particularly to flexible storage bags designed to be sealed and evacuated. The invention finds particular applicability in the field of food storage.

BACKGROUND OF THE INVENTION

Flexible plastic bags are widely used for a variety of purposes such as storing food items, either temporarily as in the case of packaging snacks or long term as in the case of freezer storage. Plastic bags of this style typically include flexible sidewalls made from, for example, polyethylene, that define an opening and an internal volume accessible through the opening. To seal the bag, interlocking closure strips may be provided about the rim of the opening.

One common problem which occurs with such bags is that, after the opening has been sealed, latent air may remain trapped in the internal volume. In addition to undesirably increasing the overall size of the sealed bag, the trapped air can cause spoilation of food items stored in the internal volume. Therefore, to remedy this problem, it is known to provide a one-way valve element attached to a flexible sidewall and communicating with the internal volume. The one-way valve element allows for the evacuation of the trapped air from the internal volume while also preventing the ingress of air from the surrounding environment into the internal volume. The one-way valve element may be activated in various ways such as, for example, by applying compressive pressure to the flexible sidewalls to force air from the internal volume or by engaging a nozzle of a vacuum source to the one-way valve element to draw air from the internal volume. An example of a one-way valve element that operates in conjunction with a vacuum source is provided in U.S. Pat. No. 6,581,641, issued to Skeens et al. and assigned to Illinois Tool Works Inc.

A problem that may arise with such bags that include one-way valve elements is that the flexible sidewall opposing the valve element and the sidewall to which the valve element is attached can actually clog the valve element preventing further evacuation. For example, it will be appreciated that placing the opposing sidewall against a solid surface and pressing the sidewall with the attached valve element toward the surface evacuates the internal volume by collapsing the sidewalls together. This also necessarily brings the opposing sidewall into contact with the valve element which can result in clogging. Likewise, where a vacuum source is used to evacuate the flexible bag, the opposing sidewall may be drawn under vacuum pressure into the valve element. A related problem is that collapsing the opposing sidewalls themselves together may trap air in other portions of the internal volume. These and other problems are remedied by the invention described herein.

BRIEF SUMMARY OF THE INVENTION

The invention provides a clearance member for preventing the opposing second sidewall from clogging the one-way valve element while maintaining communication between the valve element and the internal volume. The clearance member additionally hinders the collapsing together of the first and second sidewalls that results in trapping of air in other portions of the internal volume.

In one aspect, the clearance member is provided as a textured portion on an inner surface of the sidewall that is opposite the valve element. The textured portion provides various evacuation passages that are recessed into the opposing sidewall. Accordingly, even when the second sidewall and the valve element collapse adjacent to each other, the evacuation passages communicate with an inlet to the valve element allowing for continued evacuation. In another aspect, the clearance member can be a permeable element attached to the inner surface of the first sidewall to cover the valve element. Accordingly, the second sidewall is prevented from collapsing adjacent to the valve element by the permeable element. The permeable element, however, is comprised of a material that demonstrates high air permeability so that air can continue to access the covered valve element.

In another aspect, the clearance member is provided as a rigid structure attached to the valve element or to the sidewalls proximate to the valve element. The rigid structure spaces the opposing sidewalls apart from each other thereby allowing for continued evacuation. In yet another aspect, the clearance member may be a compressible structure attached to the valve element or sidewalls. While the compressible structure continues to prevent the complete collapsing together of the sidewalls, it also compresses to minimize the space between the sidewalls and, accordingly, minimizes the air remaining in the internal volume.

Thus, an advantage of the invention is that it assists in preventing a one-way valve element from becoming clogged with an opposing flexible sidewall. Another advantage is that it hinders the opposing sidewalls from collapsing together and thereby prevents the trapping of air within the internal volume. A related advantage is that the invention facilitates evacuation of air from the internal volume to, for example, preserve food items. These and other advantages and features of the invention will become apparent from the detailed description and the accompanying drawings.

BRIEF DESCRIPTION OF THE DRAWINGS

FIG. 2 is a front perspective view of an embodiment of a one-way valve element for attachment to the flexible bag of FIG. 1.

FIG. 3 is a rear perspective view of the one-way valve element of FIG. 2.

FIG. 4 is a cross-sectional view through the one-way valve element, as taken along line 4-4 of FIG. 2.

DETAILED DESCRIPTION OF THE INVENTION

Figure 1:
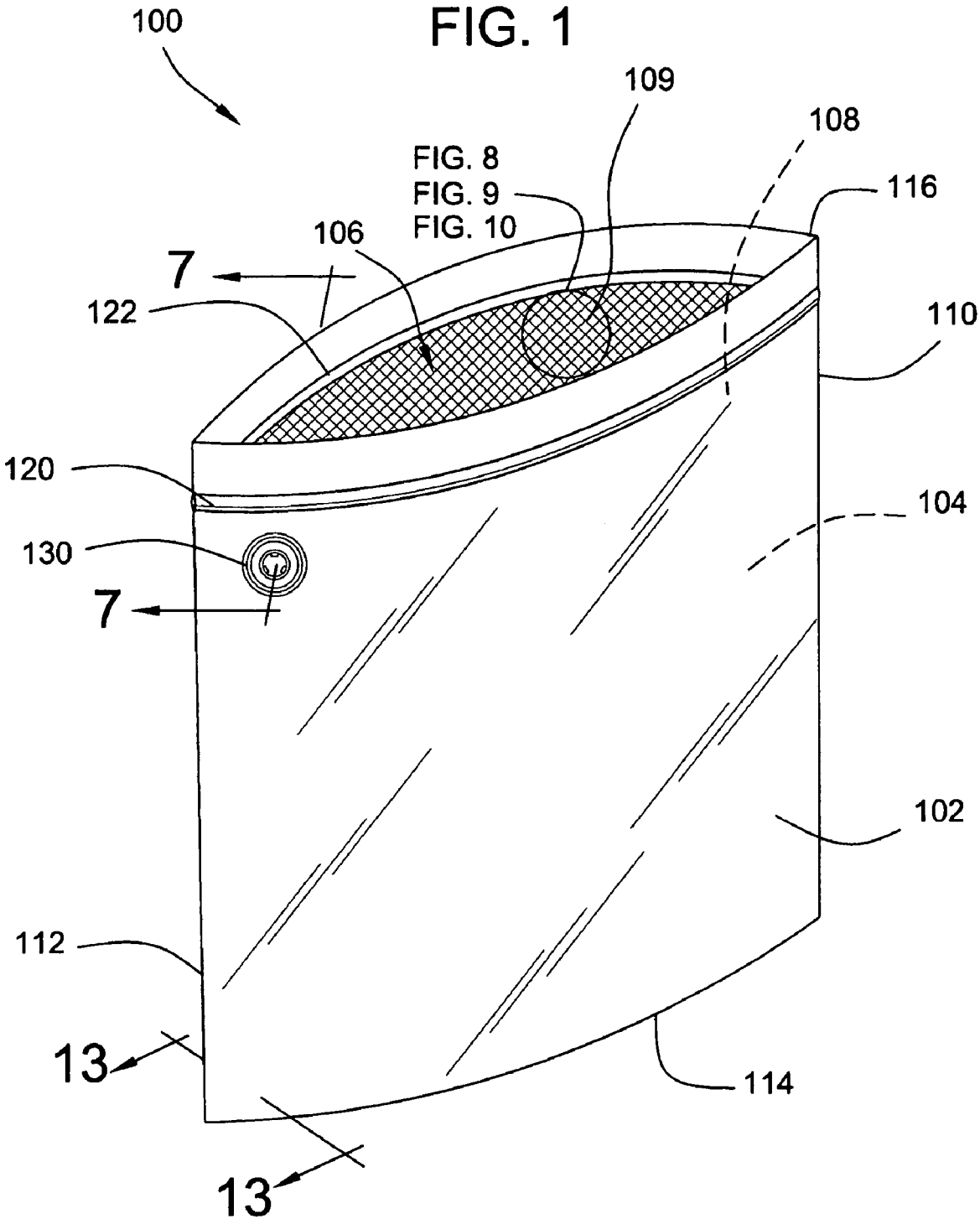
FIG. 1 is a perspective view of a flexible bag designed in accordance with the teachings of the invention having an open top, a textured portion, and an attached one-way valve element.

Now referring to the drawings, wherein like reference numbers refer to like elements, there is illustrated in FIG. 1 an flexible bag 100 designed in accordance with the teachings of the invention. In the illustrated embodiment, the flexible bag 100 includes a first sidewall 102 and an opposing second sidewall 104 overlaying the first sidewall 102 to define an internal volume 106. Accordingly, the first and second sidewall 102, 104 each includes a respective first inner surface 108 and an opposing second inner surface 109. The first and second sidewalls 102, 104 can be made from flexible webs of thermoplastic material such as, for example, polyethylene. The webs may be monolayer or multilayer film typically used for food storage. Multilayer films may be laminations or coextrusions. Resins may include polyethylene including high density (HDPE), low density (LDPE), linear low (LLDPE), nylon, ethylene vinyl alcohol (EVOH), polypropylene (PP), ethylene vinyl acetate (EVA), polyester, ionomers or metallized films. Examples of coextruded multilayer film suitable for the current invention include layered combinations such as HDPE/tie-layer/EVOH/tie-layer/LDPE or nylon/tie-layer/LDPE. For heat sealing, the sealant may be a blend of materials such that when the bag is opened the peel does not result in destruction of the bag. One such sealant material would consist of a blend of LDPE and polybutene-1 commonly referred to as a peel-seal resin whereby polybutene-1 is the minor phase. The first and second sidewalls 102, 104 are sealed together along a first side edge 110, a parallel second side edge 112, and a closed bottom edge 114 that extend perpendicularly between the first and second side edges. To access the internal volume 106, the portions of the first and second sidewalls 102, 104 extending along an open top edge 116 remain unsealed. Due to the four orthogonal edges, the flexible bag 100 has a generally rectangular shape. However, it will be appreciated that in other embodiments, the bag can have any suitable shape resulting from any number of sidewalls and edges.

To releasably close the opened top end 116 after insertion of an item for storage, there is attached to first and second sidewalls 102, 104 and parallel to the open top edge respective first and second fastening strips 120, 122. The first and second fastening strips 120, 122 can be formed from extruded, flexible thermoplastic and extend between the first and second side edges 110, 112. As will be appreciated by those of skill in the art, the first and second fastening strips 120, 122 can engage to form a seal which closes the normally open top edge 116. Of course, in other embodiments or in combination with the interlocking strips, other methods such as the use of pressure sensitive or cold seal adhesives such as those disclosed in U.S. Pat. No. 6,149,304, herein incorporated by reference in its entirety, heat-sealing, or cling can be employed to seal the open top edge.

To evacuate air trapped in the flexible bag 100 after sealing the open top edge 116, the bag includes a one-way valve element 130 that is attached to the first sidewall 102 and communicates with the internal volume 106. The one-way valve element 130 is capable of opening to allow entrapped air from the internal volume 106 to escape and closing to prevent to the ingress of environmental air into the internal volume. Communication with the internal volume 106 can be accomplished by disposing an opening through the first sidewall 102 and then attaching the valve element 130 over the opening.

Referring to FIGS. 2, 3, and 4, in an embodiment, the one-way valve element 130 can include a rigid valve body 132 that cooperates with a movable disk 134 to open and close the valve element. The valve body 132 includes a circular flange portion 136 extending between parallel first and second flange faces 140, 142. Concentric to the flange portion and projecting from the second flange face 142 is a circular boss portion 138 which terminates in a planar boss face 144 that is parallel to the first and second flange faces. The circular boss portion 138 is smaller in diameter than the flange portion 136 so that the outermost annular rim of the second flange face 142 remains exposed. The valve body 132 can be made from any suitable material such as a moldable thermoplastic material like nylon, HDPE, high impact polystyrene (HIPS), polycarbonates (PC), and the like.

Disposed concentrically into the valve body 132 is a counter-bore 148. The counter-bore extends from the first flange face 140 part way towards the boss face 144. The counter-bore 148 defines a cylindrical bore wall 150. Because it extends only part way toward the boss face 144, the counter-bore 148 forms within the valve body 132 a preferably planar valve seat 152. To establish fluid communication across the valve body, there is disposed through the valve seat 152 at least one aperture 154. In fact, in the illustrated embodiment, a plurality of apertures 154 are arranged concentrically and spaced inwardly from the cylindrical bore wall 150.

To cooperatively accommodate the movable disk 134, the disk is inserted into the counter-bore 148. Accordingly, the disk 134 is preferably smaller in diameter than the counter-bore 148 and has a thickness as measured between a first disk face 156 and a second disk face 158 that is substantially less than the length of the counter-bore 148 between the first flange face 140 and the valve seat 152. To retain the disk 134 within the counter-bore 148, there is formed proximate to the first flange face 140 a plurality of radially inward extending fingers 160. The disk 134 can be made from any suitable material such, as for example, a resilient elastomer.

Referring to FIG. 4, when the disk 134 within the counter-bore 148 is moved adjacent to the fingers 160, the valve element 130 is in its open configuration allowing air to communicate between the first flange face 140 and the boss face 144. However, when the disk 134 is adjacent the valve seat 152 thereby covering the apertures 154, the valve element 130 is in its closed configuration. To assist in sealing the disk 134 over the apertures 154, a sealing liquid can be applied to the valve seat 152. Furthermore, a foam or other resilient member may be placed in the counter-bore 148 to provide a tight fit of the disk 134 and the valve seat 152 in the closed position.

Referring to FIG. 1, to establish the one-way aspect of the valve element 130, the valve element is attached to the first sidewall 102 with the apertures exposed to the internal volume 106 and the first flange face exposed on the exterior of the flexible bag 100. Accordingly, referring to FIGS. 1 and 4, it will be appreciated that evacuation of entrapped air will move the disk 134 adjacent the fingers 160 thereby configuring the valve element 130 as opened while the ingress of air from the environment will move the disk adjacent the valve seat 152 thereby configuring the valve element as closed.

To attach the valve element 130 to the first sidewall, referring to FIG. 3, an adhesive can be applied to the exposed annular rim portion of the second flange face 142. The valve element 130 can then be placed adjacent the exterior surface of the first sidewall with the boss portion 138 being received through the hole disposed into the sidewall and thereby pass into the internal volume. Of course, in other embodiments, adhesive can be placed on other portions of the valve element, such as the first flange face, prior to attachment to the sidewall.

Figure 5:
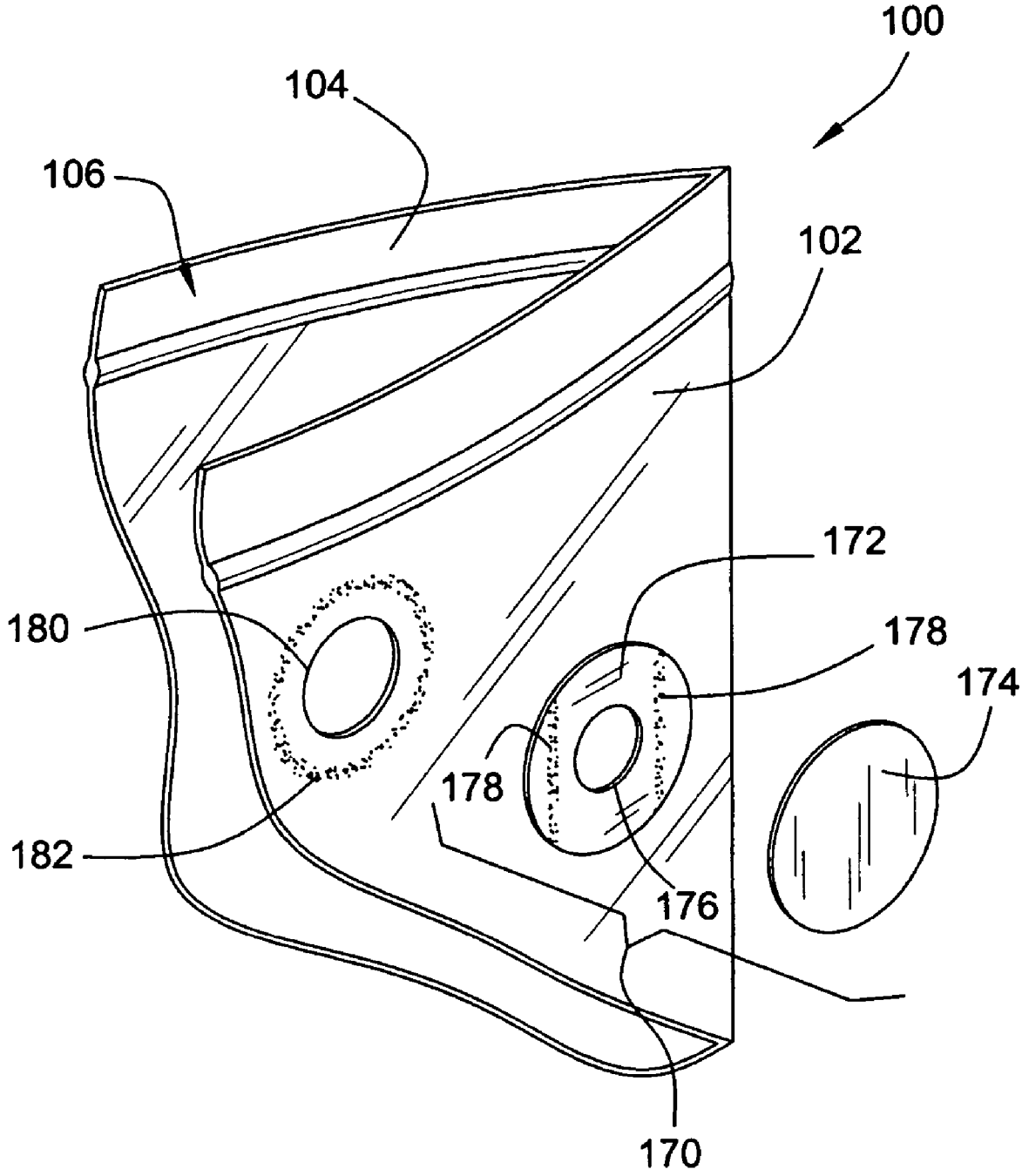
FIG. 5 is an exploded view of another embodiment of the one-way valve element for attachment to the flexible bag.

In other embodiments, the one-way valve element can have a different construction. For example, as illustrated in FIG. 5, the one-way valve element 170 can include a flexible, circular base layer 172 that cooperates with a correspondingly circular shaped, resilient top layer 174 to open and close the valve element. The top and bottom layers can be made from any suitable material such as, for example, a flexible thermoplastic film. Disposed through the center of the base layer 172 is an aperture 176, thus providing the base layer with an annular shape. The top layer 174 is tautly stretched over and adhered to the base layer 172 by two parallel strips of adhesive 178 that extend along either side of the aperture 176, thereby covering the aperture with the top layer and forming a channel. The base layer 172 and top layer 174 are then adhered by a ring of adhesive 182 to the flexible bag 100 so as to cover the hole 180 disposed through the first sidewall 102.

As will be appreciated by those of skill in the art, when the sidewalls 102, 104 of the bag 100 are forcibly compressed together, air from the internal volume 106 will pass through the hole 180 and the aperture 176 thereby partially displacing the top layer 174 from the base layer 172. The air can then pass along the channel formed between the adhesive strips 178 and escape to the environment. When the force on the sidewalls 102, 104 is released, the resilient top layer 174 will return to its stretched configuration covering and sealing the aperture 176. The valve element 170 may also contain a viscous material such as an oil, grease, or lubricant between the two layers in order to prevent air from reentering the bag. In an embodiment, base layer 172 may also be a rigid sheet material.

Figure 6:
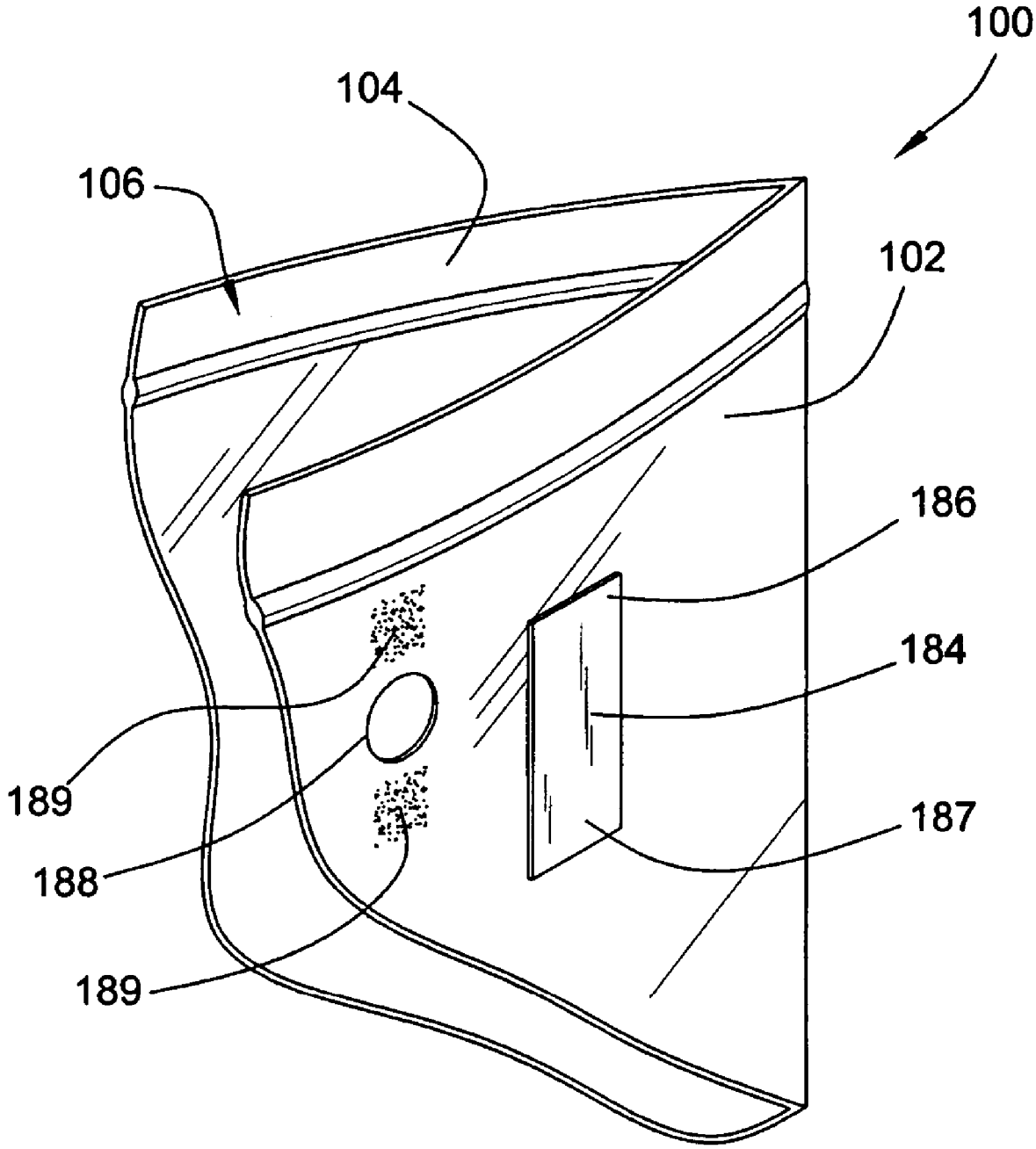
FIG. 6 is an exploded view of another embodiment of the one-way valve element for attachment to the flexible bag.

Illustrated in FIG. 6 is another embodiment of the valve element 184 that can be attached to the flexible plastic bag 100. The valve element 184 is a rectangular piece of flexible thermoplastic film that includes a first end 186 and a second end 187. The valve element 184 is attached to the first sidewall 102 so as to cover and seal a hole 188 disposed through the first sidewall 102. The valve element 184 can be attached to the sidewall 102 by patches of adhesive 189 placed on either side of the hole 188 so as to correspond to the first and second ends 186, 187. When the sidewalls 102, 104 of the flexible bag 100 are collapsed together, air from the internal volume 106 displaces the flexible valve element 184 so at to unseal the hole 188. After evacuation of air from the internal volume 106, the valve element 184 will again cover and seal the hole 188. As will be appreciated by those of skill in the art, other embodiments of one-way valve elements can be used with the flexible plastic bag such as, for example, an elastomer slit valve, duckbill valve or check valve.

Referring to FIG. 1 and from the foregoing description, it will be appreciated that if the inner surface 109 of the flexible second sidewall 104 is allowed to collapse adjacent to the first sidewall 102 proximate to the location of the one-way valve element 130, the valve element may become clogged preventing further evacuation of the bag 100. To prevent clogging of the valve element 130 by the sidewalls 102, 104, in accordance with the teachings of the invention, the bag 100 is provided with a clearance member in the internal volume 106. The clearance member maintains at least a partial clearance between the first and second sidewalls 102, 104 proximate the location of the valve element 130 to allow air from the internal volume 106 to access the valve element for exhausting.

Figure 7:
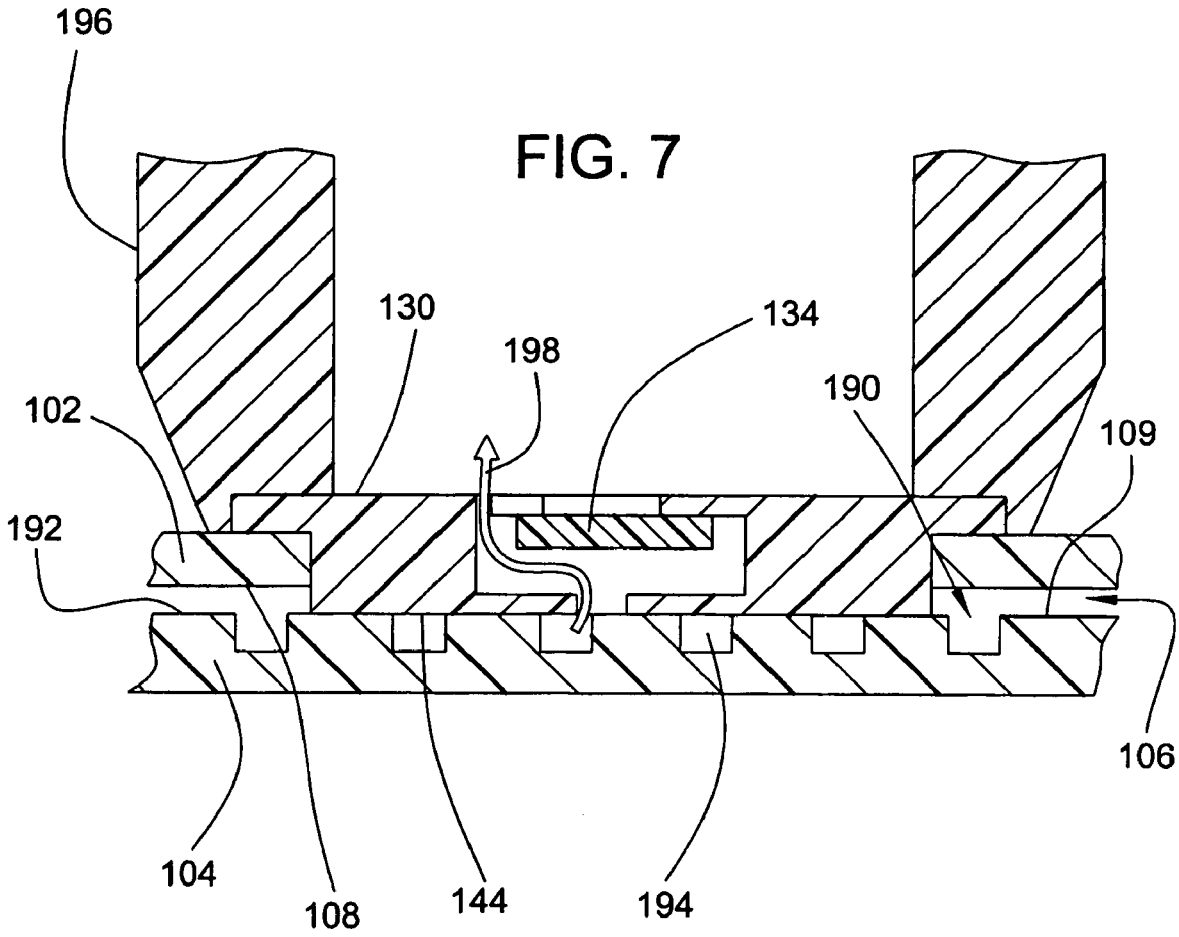
FIG. 7 is a cross-sectional view through the flexible bag and an embodiment of the one-way valve element engaging a nozzle of a vacuum source with the sidewalls of the bag collapsed together and a path of flow through the valve element indicated, as taken along line 6-6 of FIG. 1.

Referring to FIGS. 1 and 7, in accordance with one aspect of the invention, the clearance member is provided by texturing a portion 190 of the inner surface 109 of the second sidewall 104 that corresponds to the location of the one-way valve element 130 attached to the first sidewall 102. The textured portion 190 includes a plurality of alternating raised peaks 192 and recesses 194 that are formed into the inner surface 109. As illustrated in FIG. 7, when the valve element 130 is engaged to the nozzle 196 of a vacuum source to evacuate the internal volume 106 such that the first and second sidewalls 102, 104 collapse adjacent to each other, the raised peaks 192 contact the boss face 144 of the valve element 130 thereby providing clearances that function as evacuation passages within the recesses 194. Accordingly, the recesses 194 allow air, indicated by arrow 198, from within the internal volume 106 to continually access the valve element 130 and thus the textured portion 190 prevents clogging of the valve element.

The vacuum source connected to the nozzle 196 in FIG. 7 can be any suitable vacuum source including, for example, hand-operated pumps, mechanical pumps, water aspirators, oral suction, and the like. Alternatively, the flexible bag can be evacuated by collapsing the flexible sidewalls together.

Figure 8:
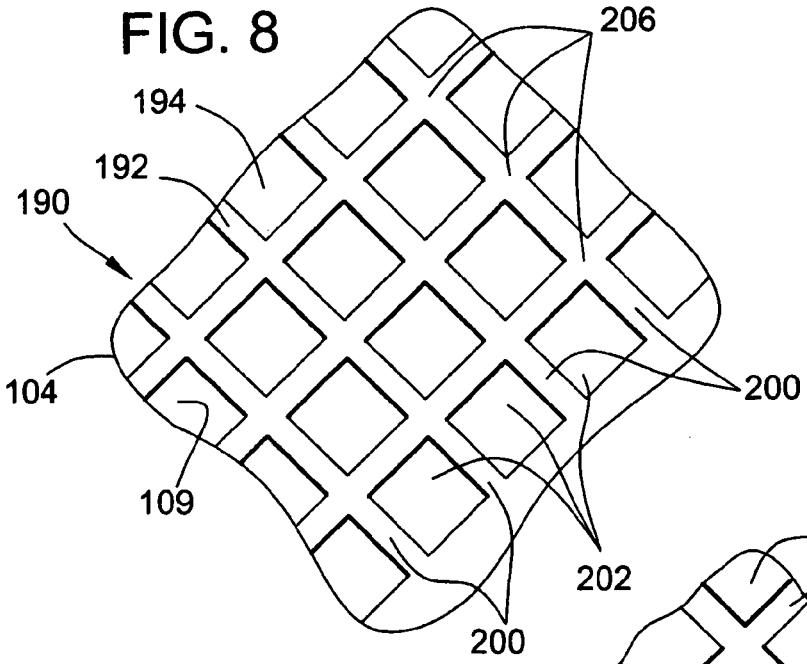
FIG. 8 is a detailed view of an embodiment of a textured portion on an inner surface of a sidewall of the flexible plastic bag, as taken about circle 8-8 of FIG. 1.
Figure 9:
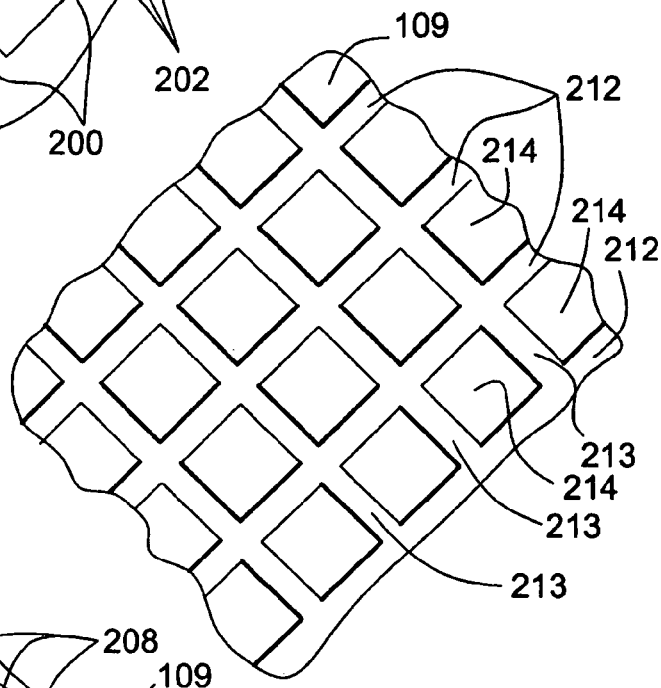
FIG. 9 is a detailed view of another embodiment of a textured portion formed as a plurality of groove disposed into an inner surface of the sidewall, taken about circle 9-9 of FIG. 1.
Figure 10:
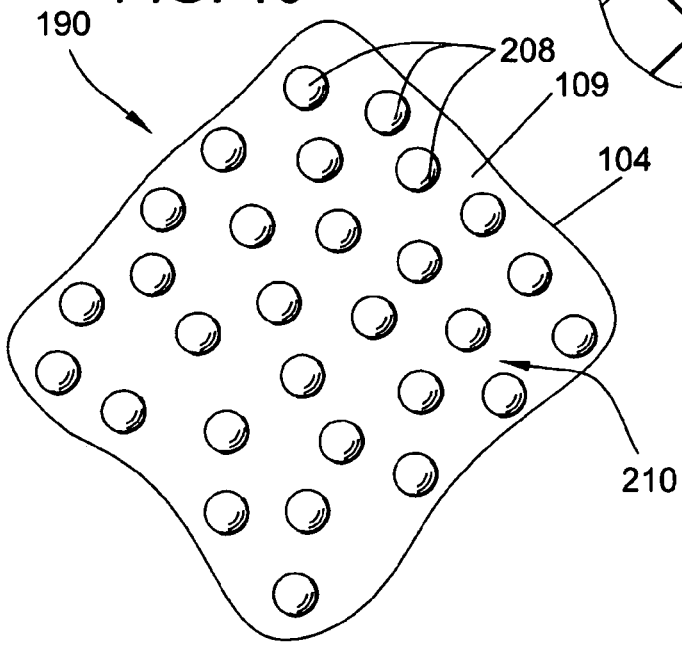
FIG. 10 is a detailed view of another embodiment of a textured portion on an inner surface of a sidewall of the flexible plastic bag, as taken about circle 10-10 of FIG. 1.

In the embodiment illustrated in FIG. 8, the peaks 192 can be formed along the crests of a first plurality of raised ridges 200 that extend along the inner surface. The first plurality of ridges 200 can be arranged parallel to and spaced-apart from each other. The recesses 202 are therefore defined within the clearances between the ridges 192. In the illustrated embodiment, a second plurality of parallel ridges 206 extends along the inner surface normal to and intersecting the first plurality of ridges 200 to form a grid-like pattern. In an alternative embodiment, the recesses can be formed within a grid-like pattern of grooves disposed into the inner surface, thus forming the raised peaks as a series of protuberances separated by the grooves. For example, in the embodiment illustrated in FIG. 9, a first and a second plurality of grooves 212, 213 are disposed into the textured portion 109 and are arranged orthogonally to each other. The grooves 212, 213 define a plurality of raised portion 214 that are square in shape. It will be appreciated that air can communicate along the grooves 212, 213 between the raised portions 214 even after the sidewalls have been collapsed together. In another embodiment illustrated in FIG. 10, the textured portion 190 can include protuberances 208 having smaller, circular shapes that are randomly dispersed along the inner surface 109 that are segregated from each other by arbitrarily-shaped recessed spaces 210 therebetween. Of course, the textured portion can have any other suitable shape, such as diamond-shaped ridges or grooves, horizontally arranged ridges or grooves, vertically arranged ridges or grooves, patterned or random curved-shaped ridges or grooves, etc.

Referring to FIG. 1, the textured portion 190 can be provided over substantially the entire second inner surface 109 between the first and second side edges 110, 112 and between the closed bottom edge 114 and fastening strips 120, 122. Moreover, the first inner surface 108 of the first sidewall 102 can likewise be provided with a textured portion. A benefit of providing the textured portion throughout the bag is that the recesses extend over the inner surface and are interconnected with one another. Accordingly, air at any location within the internal volume 106 can access the valve element 130 along the interconnected recesses even as the opposing first and second sidewalls 102, 104 collapse together, thereby preventing air in the internal volume from becoming trapped.

Of course, in other embodiments, the textured portion need not be provided over substantially the entire inner surface. For example, in the embodiment illustrated in FIG. 11, the textured portion is provided as a relatively narrow, vertical strip 220 along the first edge 110 of the second sidewall 104 arranged to correspond to the valve element 130. The remainder of the second inner surface is formed as a substantially smooth portion 222. An advantage of providing the textured portion as a narrow strip 220 adjacent the smooth portion 222 is that food items stored in the internal volume 106 are less likely to contact the textured portion, and are therefore less likely to retain unsightly impressions upon removal from the bag 100. In another embodiment illustrated in FIG. 12, the textured portion is provided as a T-shape 224 having a horizontal strip 226 and an intersecting vertical strip 228. The horizontal strip 226 extends between the first and second side edges 110, 112 while being spaced-apart from the bottom edge 114. The vertical strip 228 extends between the bottom edge 114 and the horizontal strip 226 while being spaced-apart from the first and second side edges 110, 112. Accordingly, the T-shape textured portion 224 can extend substantially throughout the internal volume 106 between the opposing side edges 110, 112 and the top and bottom edges 114, 116 while still providing substantially smooth portions 230, 232.

Figure 13:
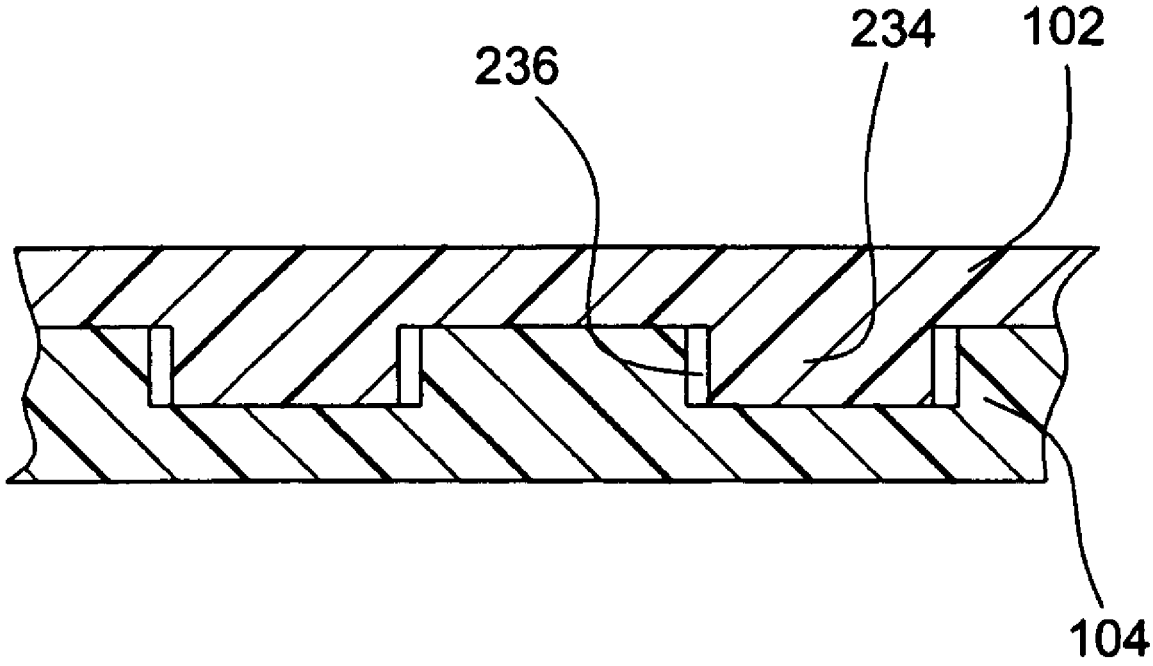
FIG. 13 is a partial cross-sectional view through an embodiment of the flexible bag with the sidewalls of the bag collapsed together, as taken along line 13-13 of FIG. 1.

In another embodiment illustrated in FIG. 13, to maximize exhaustion of the flexible bag wherein the textured portion is located on both the first and second sidewalls 102, 104, the peaks 234 and recesses 236 can be arranged and sized to cooperate so as to minimize the remaining internal volume as the sidewalls collapse together. For example, the peaks 234 located on each sidewall are received in corresponding recesses 236 formed on the opposing sidewall to interlock together.

Figure 14:
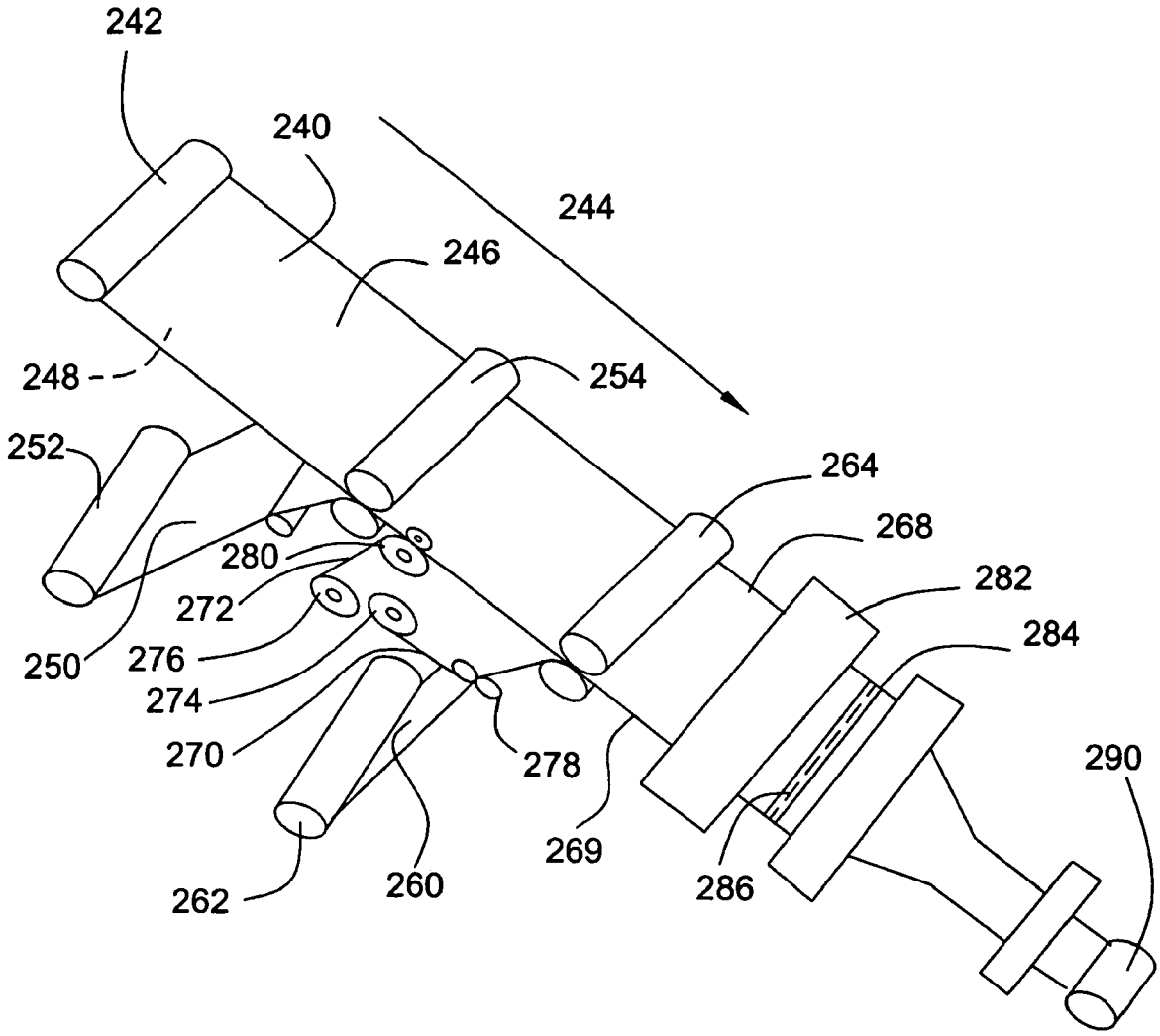
FIG. 14 is a general schematic view illustrating a method for producing a flexible bag having a textured portion using continuous webs of plastic.

To produce a flexible bag having a textured portion, webs of flexible thermoplastic material can be manipulated through a high speed manufacturing process such as that illustrated in FIG. 14. In the manufacturing process, a first web 240 of thermoplastic material is continuously unwound from a roll 242 and aligned in and advanced along a machine direction 244 through the processing machines. The first web of material 240 accordingly has a first surface 246 and a second surface 248.

A second web 250 of thermoplastic material is provided wound onto a second roll 252 located below the first roll. Embossed into the material of the second web 250 are pluralities of peaks and recesses that form the textured portion of the finished flexible bag. The second web 250 is continuously unwound from the second roll 252 and aligned with the machine direction 244 where it is attached to the second surface 248 of the advancing first web 240 by web attachment rollers 254. As will be appreciated, the attached first and second webs 240, 250 will form the second sidewall of the finished flexible bag.

To provide the first sidewall, a third web 260 of thermoplastic material is provided wound onto roll 262. The third web 260 is continuously unwound and aligned with the first and second webs 240, 250 in the machine direction 244. After alignment, the third web 260 is attached to the first and second webs 240, 250 at a second set of web attachment rollers 264. In order to form the open top edge of the finished bag, the third web 260 is only attached to the first and second webs 240, 250 along a first edge 268 of the combined webs while the parallel second edge 269 remains unattached.

To provide the fastening strips on the finished bag, the first and second fastening strips 270, 272 can be provided as elongated thermoplastic extrusions wound onto first and second strip rolls 274, 276. The first fastening strip 270 is unwound and aligned with the third web 260 to which the first fastening strip is attached by strip attachment rollers 278. The second fastening strip 272 is unwound and aligned in the machine direction 244 with the first and second webs to which the second fastening strip is continuously attached by strip rollers 280. As illustrated in FIG. 14, the first and second fastening strips 270, 272 are aligned with the unattached second edge 269 of the combined webs. Preferably, attachment of the fastening strips to the continuously advancing webs of thermoplastic material occurs between the first and second web attachment rollers 254, 264.

As the attached webs and strips are advanced in the machine direction 244, the side edges of the finished bag may be produced by an edging machine 282. Specifically, the edging machine 282 forms a seal 284 across the width of the attached webs and then cuts perforations 286 along the seal. The perforated webs can then be folded by a folding machine 288 and wound into a roll 290 for distribution. Later, individual bags can be unwound and detached from the roll 290 along the perforated seals.

In another embodiment, instead of providing the textured portion in the form of a separate web of material, the textured portion can be formed directly onto the first web 240 of advancing material. For example, the second roll 252 and second web 250 of material can be eliminated and the first web attachment rollers 254 can be replaced with an embossing machine that forms the peaks and recesses directly onto the first web 240.

Figure 15:
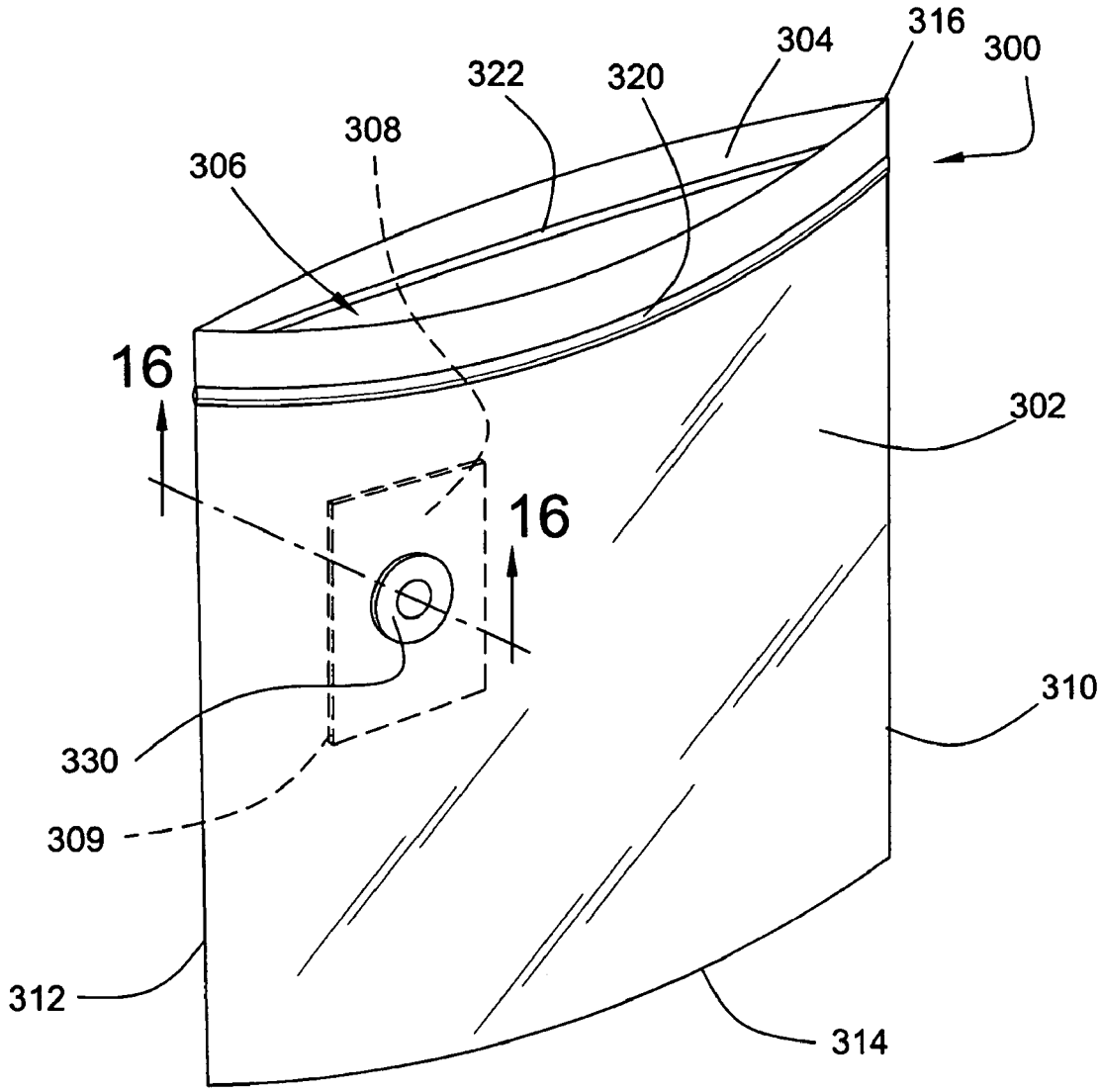
FIG. 15 is a perspective view of another embodiment of a flexible bag having an open top, a permeable element, and a one-way valve element.
Figure 16:
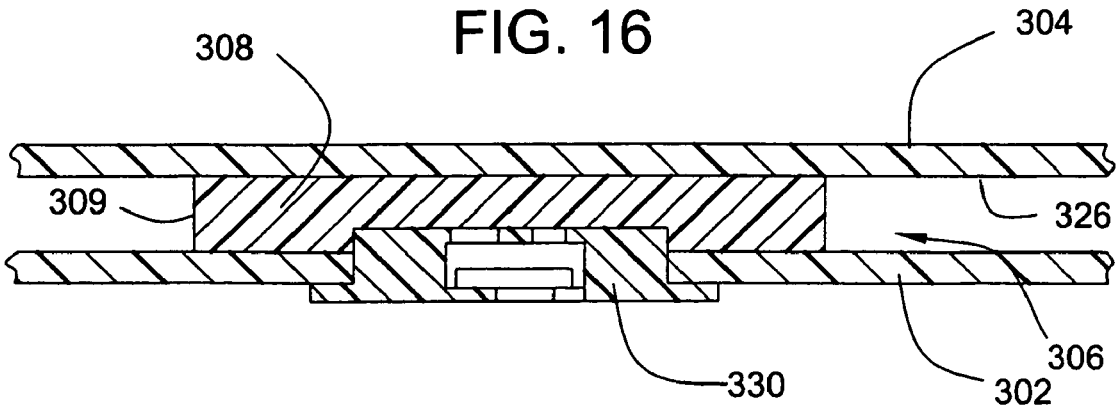
FIG. 16 is a cross-sectional view through the flexible bag, permeable element, and one-way valve element with the sidewalls of the bag collapsed together, as taken about line 16-16 of FIG. 15.

In another aspect of the invention, as illustrated in FIGS. 15 and 16, the clearance member can be provided as a permeable element 308 located in the internal volume 306 of the flexible bag 300. In addition to the permeable element 308, the flexible bag 300 includes overlaying first and second sidewalls 302 and 304 that are sealed together along first and second side edges 310, 312 and a closed bottom edge 314. To access the internal volume 306, the edges of the first and second sidewalls 302, 304 that are parallel to the closed bottom edge 314 remain unsealed to form an open top edge 316. To releasably close the open top edge 316 after insertion of an item, first and second fastening strips 320, 322 are provided. To evacuate air from the flexible bag after sealing the fastening strips, a one-way valve element 330 is attached to the first sidewall 302 and communicates with the internal volume 306.

The permeable element 308 can be provided as a thickened planar sheet outlined by a peripheral edge 309 that defines the shape of the permeable element. The permeable element can be attached by, for example, adhesive to an inner surface 324 of the first sidewall 302 such that the permeable element overlays and covers the one-way valve element 330. In another embodiment, the permeable element 308 can be attached to the second sidewall 304 opposite the valve element 330. The permeable element 308 is characterized in that it comprises a material that demonstrates a high degree of air permeability.

As illustrated in FIG. 16, during evacuation of the flexible bag 300, as the second sidewall 304 collapses toward the first sidewall 302, an inner surface 326 of the second sidewall 304 contacts the permeable material 308 and is therefore spaced-apart from the valve element 330. Air from the internal volume 306 of the bag 300, however, can still access the exposed peripheral edge 309 of the permeable element and permeate through to the valve element 330.

Examples of various permeable materials suitable for the permeable element include any of various nonwoven materials such as, but not limited to, melt blown, spun bond, hydroentangled, needle punched, batting, dry-laid or wet-laid. Preferably, the selected nonwoven material demonstrates a hydrophobic property that permits air to permeate through but retains liquids. As will be appreciated, such a hydrophobic permeable material would prevent fluids from leaking through the one-way valve element or from drying out within the valve element. A preferred material is polypropylene but the nonwoven material could also be made from polyester, nylon, or polyethylene. Other examples of suitable permeable materials include porous materials such as open celled foams such as sponges, porous substrates, and sintered materials.

In another aspect of the invention, the clearance member can be provided as a rigid structure that functions to space the sidewalls apart from each other in the proximity of the valve element during evacuation. The rigid clearance member may include slots or notches disposed into it that permit air from the internal volume to access the valve element. Because of the combined effect of the rigid clearance member in spacing the sidewalls apart and providing access to the valve element, clogging of the valve element is prevented. Preferably, the rigid clearance member is engaged to the valve element itself but in some embodiments the rigid clearance member can be attached to the opposing sidewall.

Figure 17:
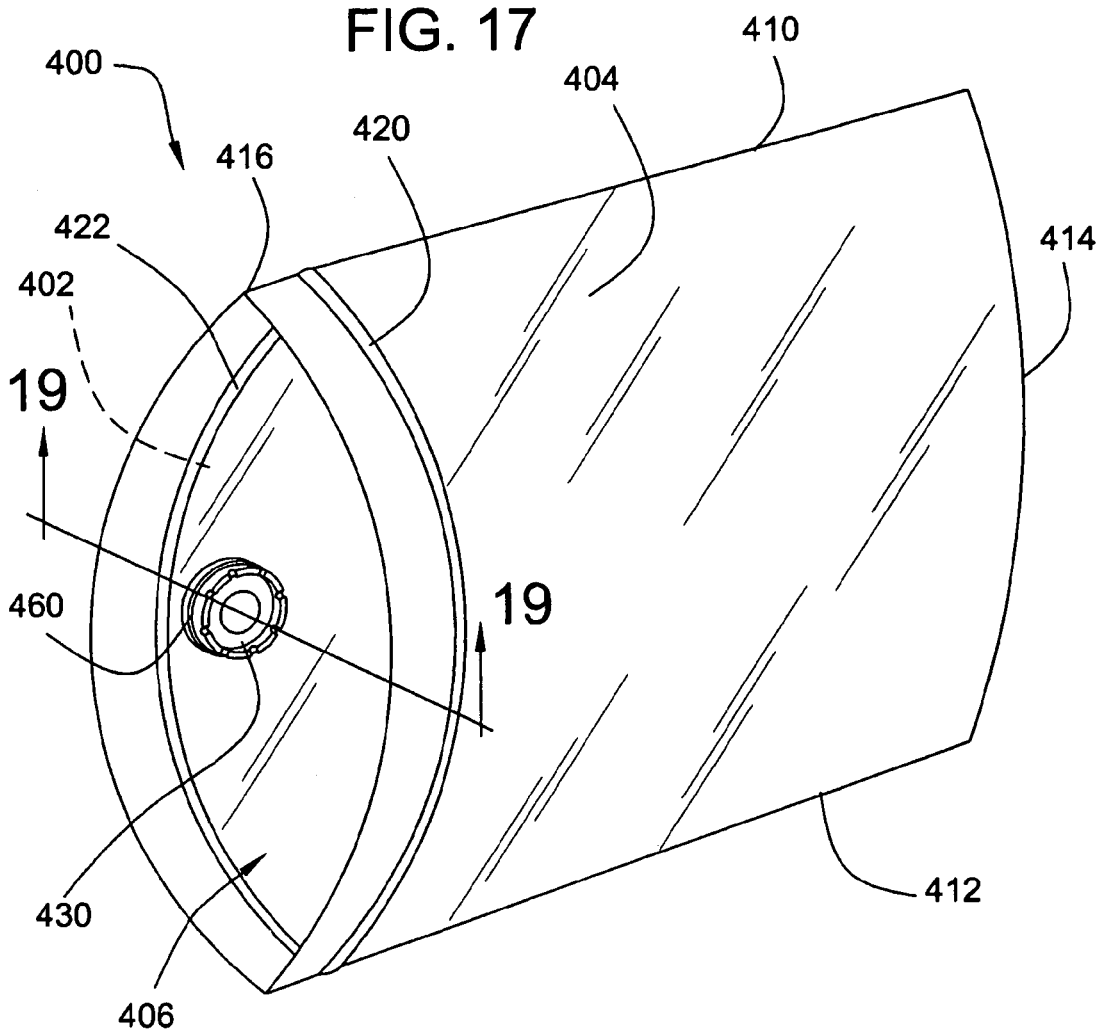
FIG. 17 is a perspective view of a flexible bag having an open top, a one-way valve element, and a clearance member.

An embodiment of the rigid clearance member in the form of a band 460 engaged to a valve element 430 attached to a flexible bag 400 is illustrated in FIG. 17. The flexible bag 400 is formed from overlapping first and second flexible sidewalls 402, 404 that are joined along parallel first and second side edges 410, 412 and a closed bottom edge 414 to define an internal volume 406. To access the internal volume 406, the portions of the first and second sidewalls opposite the closed bottom edge 414 remain unsealed to form an open top edge 416. To releasably close the open top edge 416 after insertion of an item, first and second fastening strips 420, 422 are provided.

Figure 18:
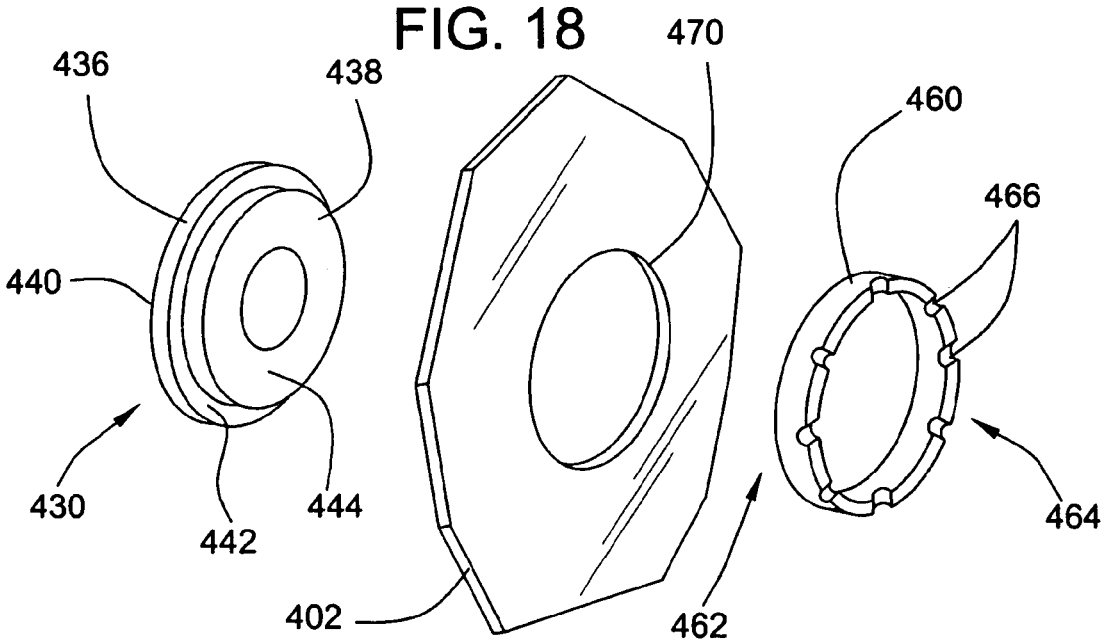
FIG. 18 is an exploded view of the flexible bag, the one-way valve element, and clearance member of FIG. 17.

Referring to FIG. 18, the band 460 can be shaped as an annular ring having a first face 462 and an opposing second face 464. Disposed into the second face 464 of the annular band 460 along the perimeter are a plurality of notches 466 that extend toward the first face 462. To engage the band 460 to the valve element 430, the valve element includes a circular flange portion 436 from which projects a smaller, circular boss portion 438. The boss portion 438 of the valve element 430 is inserted through an appropriately sized hole 470 formed into the first sidewall 402 of the flexible bag. When the valve element 430 is thus attached, it will be appreciated that the boss portion 438 projects into the internal volume 406 towards the second sidewall 404.

Preferably, the inner diameter of the band 460 is sized to slidably fit about the circular, projecting boss portion 438. Accordingly, when the boss portion 438 and band 460 are fit together, the first sidewall 402 is sandwiched between the valve element 430 and band. So that the second face 464 of the band 460 projects into the internal volume, the length of the band between the first and second faces 462, 464 is greater than the length of the projecting portion 438 between the second flange face 442 and the boss face 444. In various embodiments, the band and the boss portion can be secured by adhesive, friction fit, or can be an integral portion of the valve.

Figure 19:
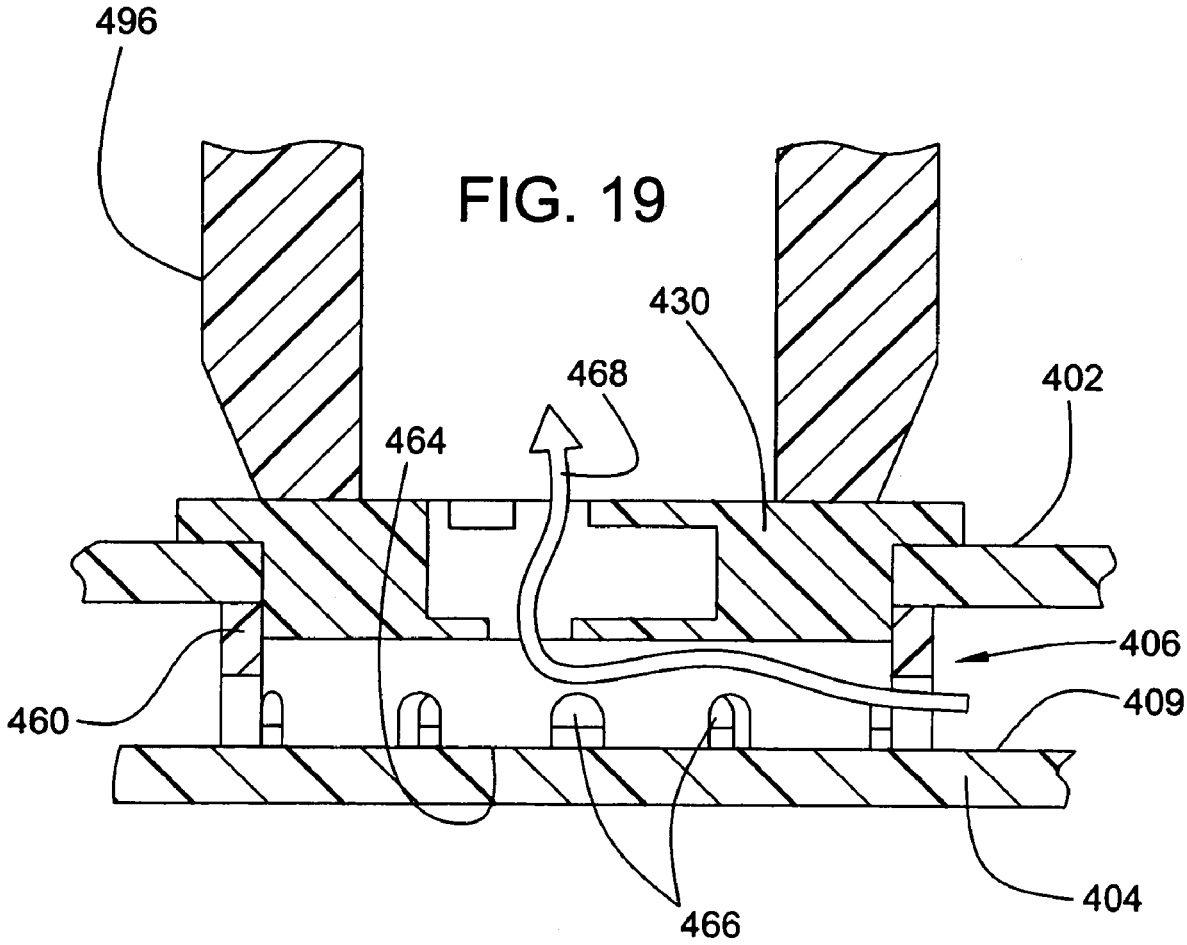
FIG. 19 is a cross-sectional view through the flexible bag, the one-way valve element engaged to a nozzle of a vacuum source, and the clearance member with the sidewalls of the bag collapsed together and a path of flow through the valve element indicated, as taken along lines 19-19 of FIG. 17.

As illustrated in FIG. 19, when a nozzle 496 of a vacuum source is engaged to the valve element 430 so as to evacuate the flexible bag 400 such that the second sidewall 404 collapses toward the first sidewall 402, the inner surface 409 of the second sidewall contacts the second face 464 of the band 460 and is therefore spaced-apart from the valve element 430. Air, indicated by arrow 486, from the internal volume 406 of the bag 400 can still access the valve element 430 through the notches 466 disposed through the band 460. Specifically, if the notches 466 are sufficiently narrow and extend far enough toward the first face 462 of the band, it will be appreciated that the second sidewall 404 cannot be completely drawn into the notches. Hence, the valve element 430 is prevented from clogging by the band 460. Preferably, the band and the valve element are made of a moldable thermoplastic material.

The vacuum source connected to the nozzle 496 in FIG. 19 can be any suitable vacuum source including, for example, hand-operated pumps, mechanical pumps, water aspirators, oral suction, and the like. Alternatively, the flexible bag can be evacuated by collapsing the flexible sidewalls together.

Figure 20:
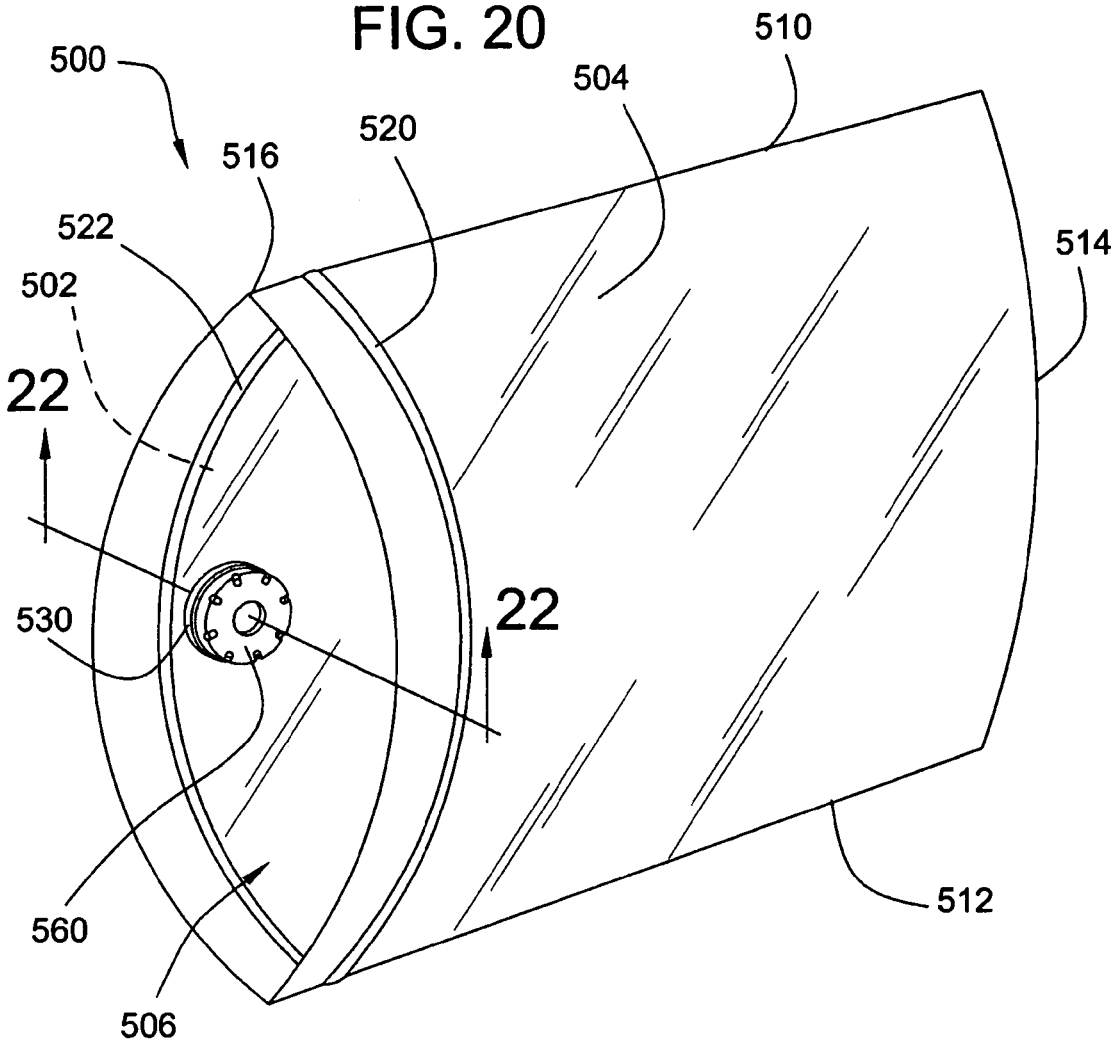
FIG. 20 is a perspective view of a flexible bag having an open top, a one-way valve element, and another embodiment of the clearance member.

In FIG. 20, another embodiment of the rigid clearance member in the form of a cap 560 is illustrated engaged to a valve element 530 attached to a flexible bag 500. As described above, the flexible bag 500 also includes overlapping first and second sidewalls joined along parallel first and second side edges 510, 512 and a perpendicular closed bottom edge 514 to define an internal volume 506. To access the internal volume 506, the portions of the first and second sidewalls 502, 504 opposite the closed bottom edge 514 remain unsealed to form an open top edge 516. To releasably close the open top edge 516 after insertion of an item, first and second fastening strips 520, 522 are provided.

Figure 21:
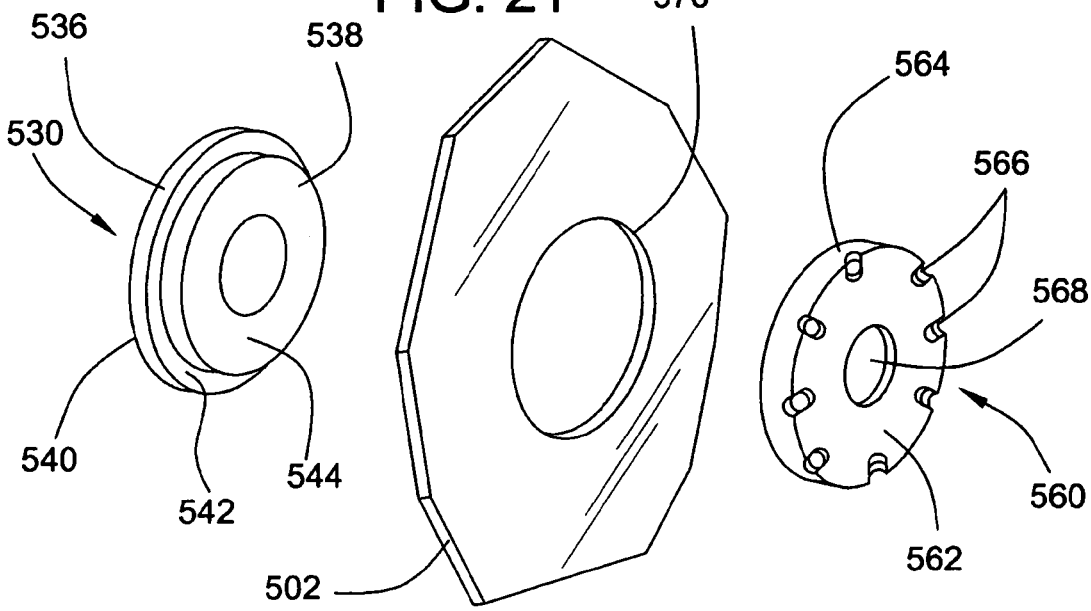
FIG. 21 is an exploded view of the flexible bag, the one-way valve element, and the clearance member of FIG. 20.

Referring to FIG. 21, the cap 560 includes a circular cap top 562 from the periphery of which extends a perpendicular cap wall 564. Disposed through the intersection of the cap top and cap wall are a plurality of peripheral apertures 566 while disposed through the center of the cap top is a central aperture 568. To engage the cap 560 to the valve element 530, the valve element includes a circular flange portion 536 from which projects a smaller, circular boss portion 538. The boss portion 538 of the valve element 530 is inserted through an appropriately sized hole 570 formed into the first sidewall 502 of the flexible bag. When the valve element 530 is thus attached, it will be appreciated that the boss portion 538 projects into the internal volume 506 towards the second sidewall 504. Preferably, the inner diameter of the peripheral cap wall 564 is sized to slidably fit about the circular, projecting boss portion 538. Accordingly, when the boss portion 538 and cap wall 564 are fit together, the first sidewall 502 is sandwiched between the valve element 530 and cap 560. In various embodiments, the cap and the boss portion can be secured together by adhesive, friction fit, or be an integral portion of the valve.

Figure 22:
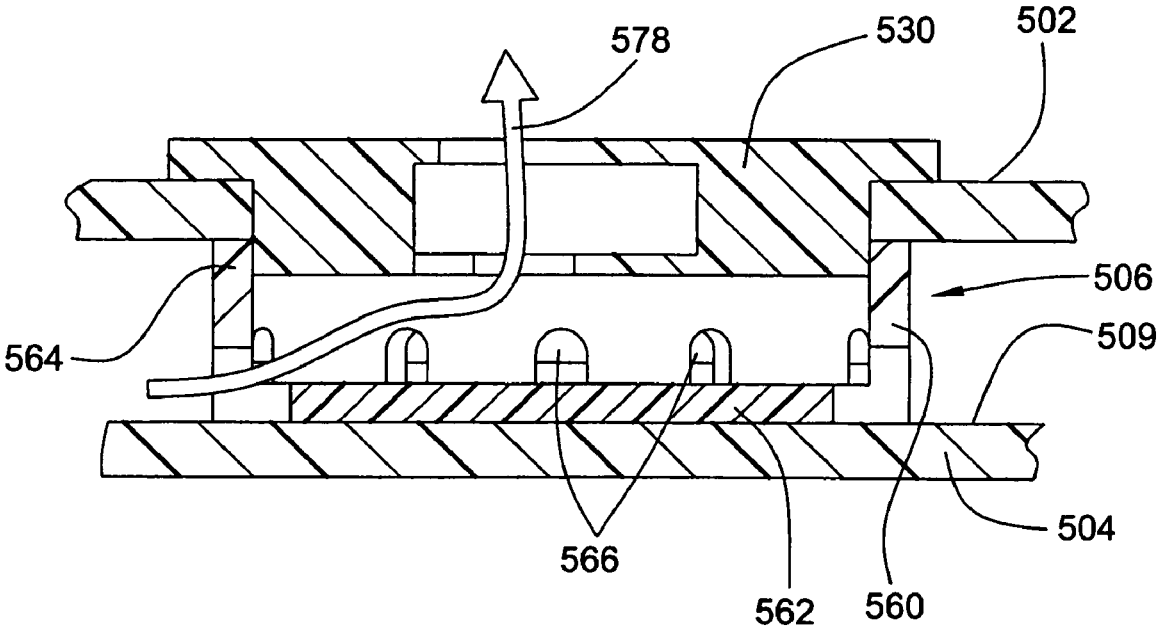
FIG. 22 is a cross-sectional view through the flexible bag, one-way valve element, and the clearance member with the sidewalls of the bag collapsed together and a path of flow through the valve element indicated, as taken along line 22-22 of FIG. 20.

As illustrated in FIG. 22, during evacuation of the flexible bag 500 as the second sidewall 504 collapses toward the first sidewall 502, the inner surface 509 of the second sidewall contacts the cap top 562 of the cap 560 and is therefore spaced-apart from the valve element 530. In this situation, the central aperture 568 becomes covered by the second sidewall 504. Air, indicated by arrow 578, from the internal volume 506 of the bag 500 can still access the valve element 530 through the peripheral apertures 566 disposed through the cap 560. Hence, the valve element 530 is prevented from clogging by the cap 560. An advantage of the cap 560 over the aforementioned band is that cap top 562 more completely prevents the second sidewall 504 from collapsing adjacent to the valve element 530. Additionally, to improve the evacuation of the internal volume 506, the central aperture 568 provides substantial additional access to the valve element 530 than the peripheral apertures 566 standing alone, at least prior to the central aperture becoming covered by the second sidewall 504. Preferably, the cap 560 is made from a moldable thermoplastic material.

Figure 23:
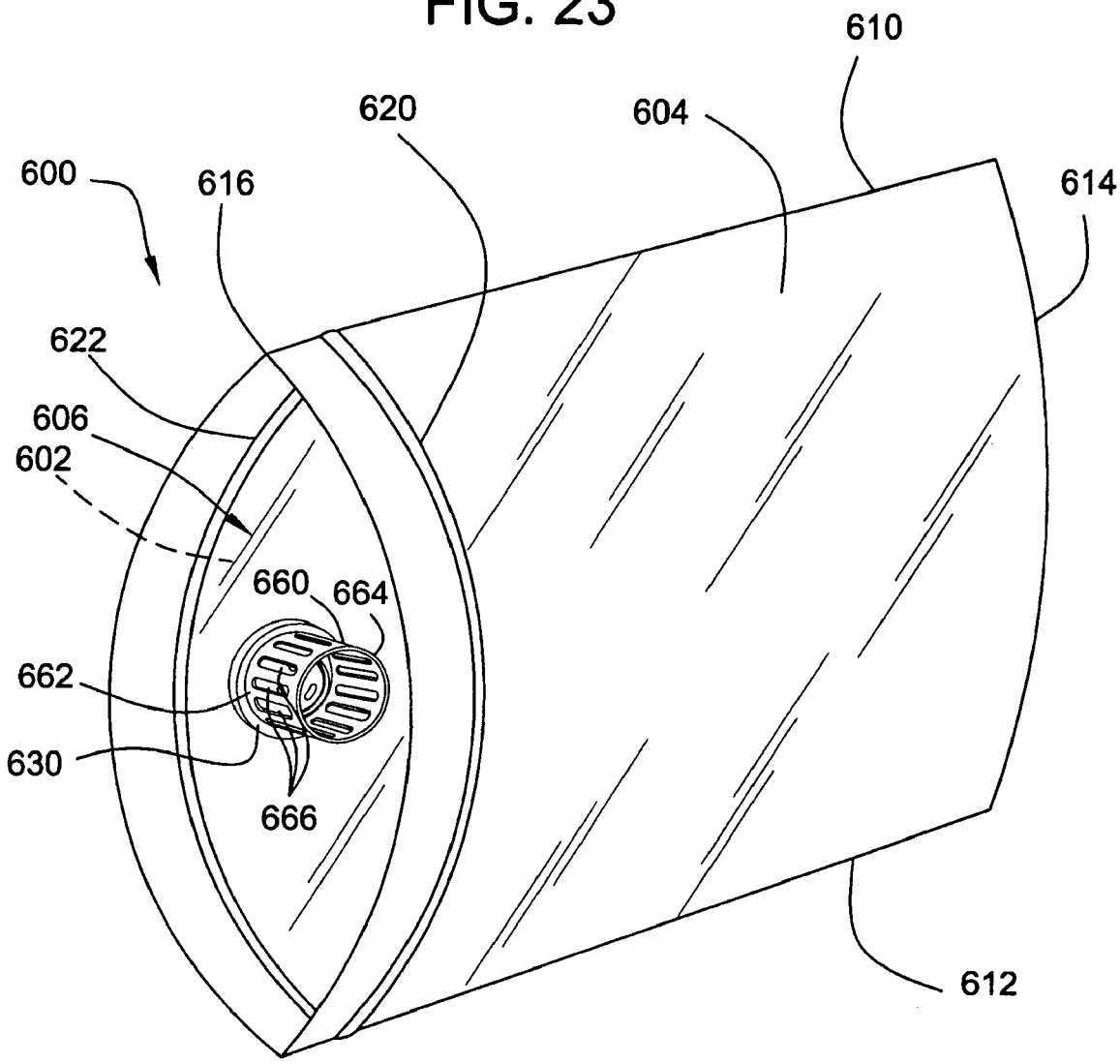
FIG. 23 is a perspective view of a flexible bag having an open top, a one-way valve element, and another embodiment of the clearance member.

Illustrated in FIG. 23 is another embodiment of a rigid clearance member in the form of an elongated sleeve 660 engaged to a valve element 630 attached to a flexible bag 600. As described above, the flexible bag 600 includes overlapping first and second sidewalls 602, 604 that are joined along parallel first and second side edges 610, 612 and a perpendicular closed bottom edge 614 that define an internal volume 606. To access the internal volume 606, the portions of the first and second sidewalls 602, 604 opposite the closed bottom edge 614 remain unsealed to form an open top edge 616. To releasably close the open top edge 616 after insertion of an item, first and second fastening strips 620, 622 are provided.

The elongated sleeve 660 is formed as a cylindrical structure that extends between a first face 662 and a second face 664. Disposed through the sleeve 660 about the periphery are a plurality of slots 666. The cylindrical sleeve 660 can be sized to slideably engage with the circular valve element 630 in the above described manner with the second face 664 projecting into the internal volume 606 towards the second sidewall 604. Referring to FIG. 23, it will be appreciated that as the first and second sidewalls 602, 604 collapse towards each other, the sleeve 660 will function to space the sidewalls apart in the proximity of the valve element 630. The slots 666 disposed through the sleeve 660, however, will continue to allow air to access the one-way valve element 630 from the internal volume 606. Hence, the valve element is prevented from clogging by the sleeve. Preferably, the sleeve is made from a moldable thermoplastic or a formed strip of metal.

Figure 24:
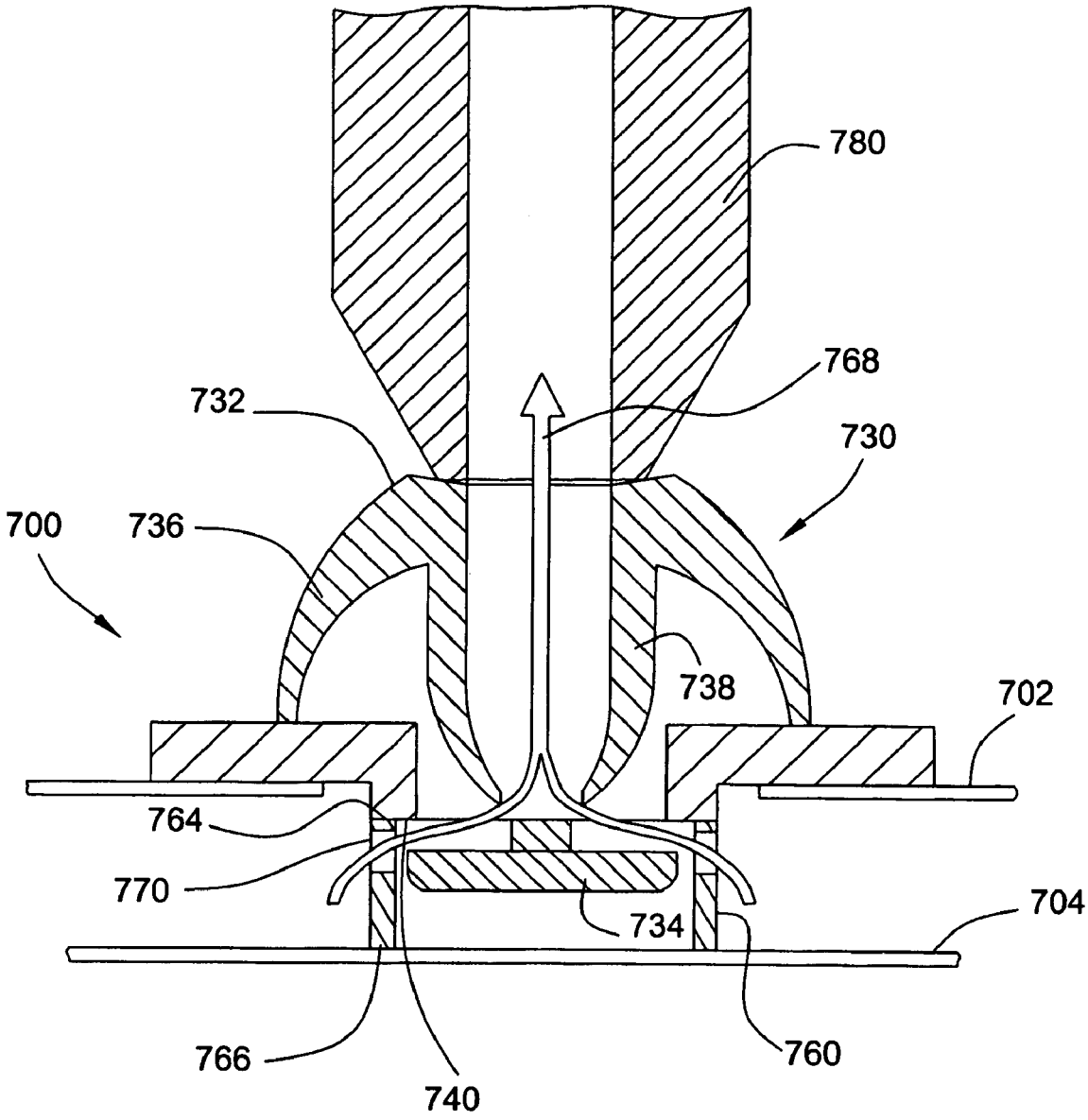
FIG. 24 is a cross-sectional view of a flexible bag having a one-way valve element and a clearance member, the flexible bag being evacuated by a vacuum nozzle with a path of flow indicated.

Illustrated in FIG. 24 is a flexible bag 700 having attached to it a one-way valve element 730 of the type disclosed in U.S. Pat. No. 6,581,641, herein incorporated by reference. The flexible bag 700 also includes a first sidewall 702 to which the valve element 730 is attached and an opposing second sidewall 704. The one-way valve element 730 includes a resilient cap 732 that is mounted to a valve base 734. The resilient cap 732 includes an outer wall 736 that surrounds a central stem 738. The valve element 730 also includes a valve gate 734 that normally sits against a valve seat face 740 that is formed on the valve base 734. To evacuate the flexible bag 700, a vacuum nozzle 780 that communicates with a vacuum source can engage the valve element 730. The nozzle 780 engages the valve element 730 by pressing the nozzle against the outer wall 736 of the cap 732. This forces the stem 738 downwards which displaces the valve gate from the valve seat surface 740. Air from inside the flexible plastic bag can then access the nozzle.

It will be appreciated that when the nozzle 780 is pressed against the valve element 730, the second sidewall 704 can collapse against and clog the valve element. To prevent this from occurring, an embodiment of the clearance member 760 is attached to the valve element 730. The clearance member 760 is formed as a circular wall extending between a first end 764 and a second end 766. The first end 764 is attached to the valve base 734 such that the second end 766 is directed towards the second sidewall 704. Disposed through the circular wall 762 are a plurality of apertures 770 through which air, indicated by arrow 768, can pass. Accordingly, when the vacuum nozzle 780 is pressed against the cap 732, the clearance member 760 prevents the second sidewall 704 from entering and clogging the valve element 730.

In another aspect of the present invention, the clearance element can be provided as compressible structure comprised from a compressible material. The compressible clearance member can be attached to either the valve element or to an inner surface of a sidewall proximate the valve element. Accordingly, the compressible clearance member will prevent the sidewalls from completely collapsing together proximate the valve element. An advantage of utilizing the compressible clearance member is that while the sidewalls remain spaced-apart, the compressible clearance member compresses to minimize the air remaining in the internal volume. Another advantage of utilizing a compressible clearance member is that the compressible clearance member urges back against the sidewalls. Therefore, if the valve element were to become clogged by the sidewalls, the compressible structure could unclog the valve element by urging the first and second sidewalls apart.

Figure 25:
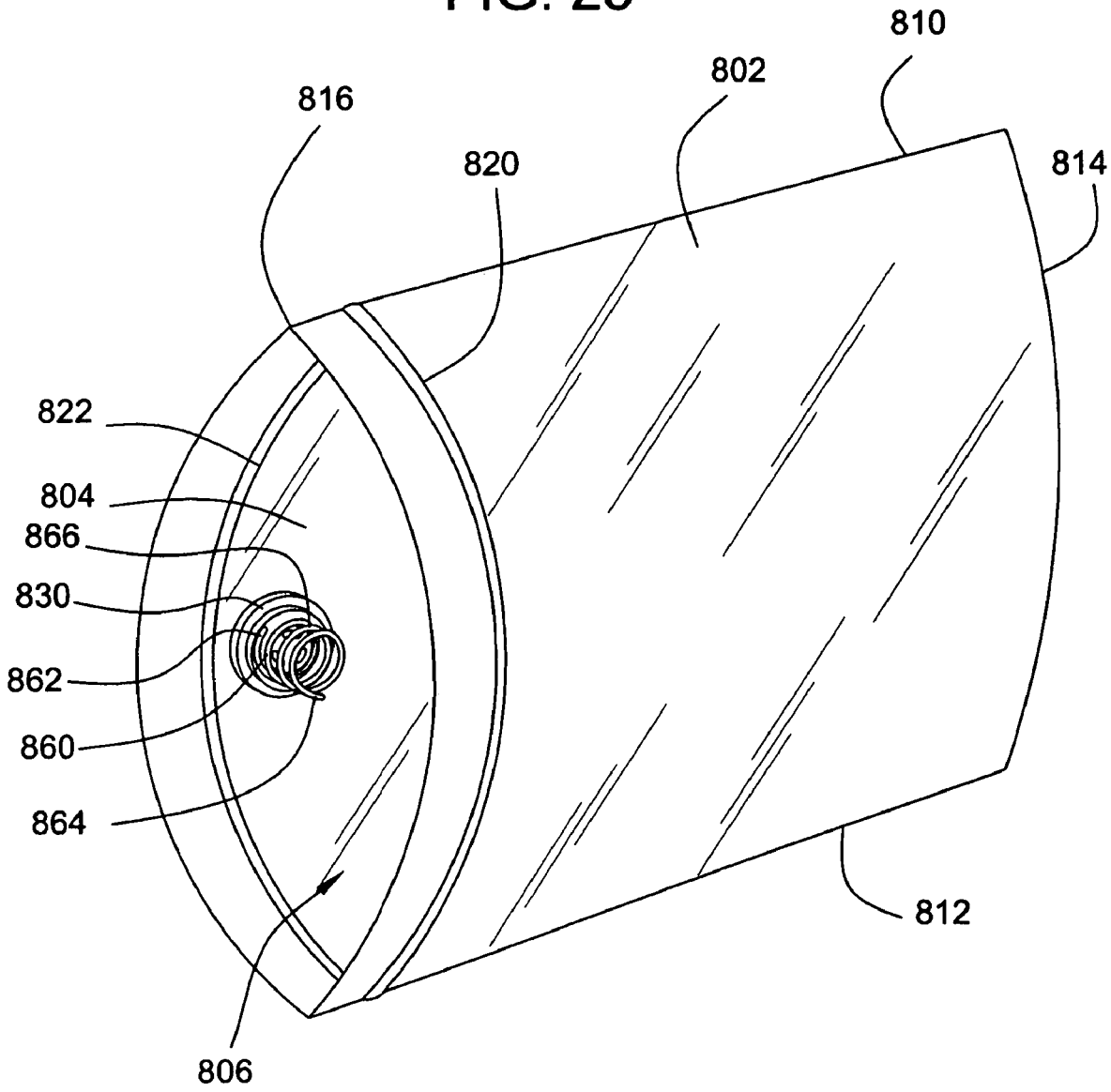
FIG. 25 is a perspective view of a flexible bag having an open top, a one-way valve element, and a compressible clearance member.

Referring to FIG. 25, an embodiment of a flexible bag 800 having a compressible clearance member in the form of a spring 860 engaged to a one-way valve element 830 is illustrated. As described above, the flexible bag 800 includes overlapping first and second sidewalls 802, 804 that are joined along parallel first and second side edges 810, 812 and a perpendicular closed bottom edge 814 that define an internal volume 806. To access the internal volume 806, the portions of the first and second sidewalls 802, 804 opposite the closed bottom edge 814 remain unsealed to form an opened top edge 816. To releasably close the opened top edge 816 after insertion of an item, first and second fastening strips 820, 822 are provided.

The spring 860 is formed as helical spring comprised of a plurality of hoops 866 that extends between a first end 862 and a second end 864. The first end 862 engages the valve element 830 by, for example, adhesive attachment such that the second end 864 projects into the internal volume 806 toward the second sidewall 804. In other embodiments, the spring can be secured to the valve element by a friction fit, a snap-lock engagement, or adhesive. During evacuation, as the first and second sidewalls 802, 804 collapse together, the second sidewall 804 will contact the second end 864 of the spring 860 and begin to compress the spring towards the first sidewall. Conversely, the spring 860 will urge the second sidewall 804 away from the valve element 830 preventing the valve element from becoming clogged. Moreover, because of the substantial space between the alternating hoops 866 of the spring 860, air will continue to access to the valve element 830. Preferably, the spring is made from any suitable resilient material such as spring steel or a resilient thermoplastic. In another embodiment, a structure comprising a tube with axially-spaced, collapsible, accordion pleats and holes disposed therethrough can be employed as the compressible clearance member.

Figure 26:
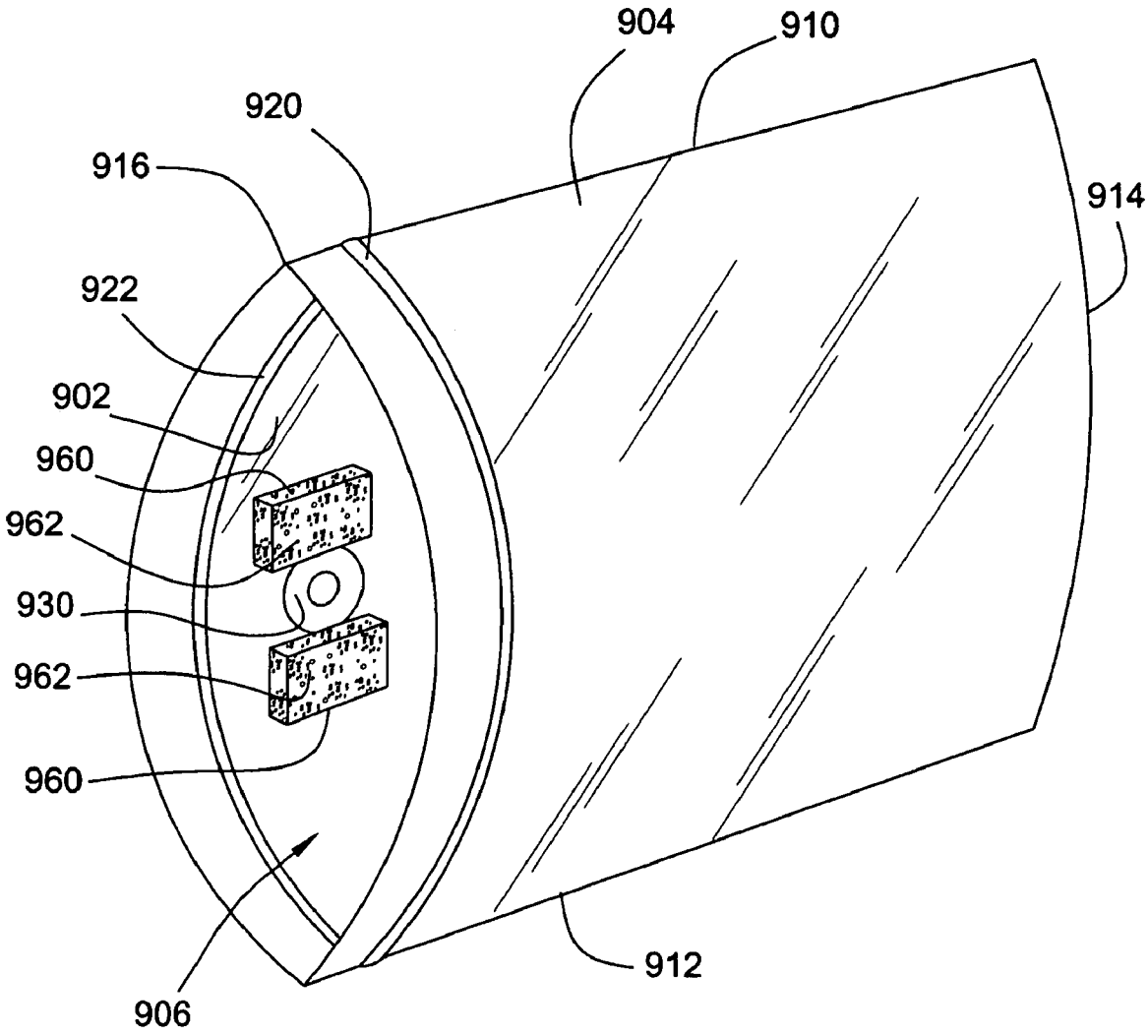
FIG. 26 is a perspective view of a flexible bag having an open top, a one-way valve element and another embodiment of a compressible clearance member.

Illustrated in FIG. 26 is another embodiment of a flexible bag 900 having a compressible clearance member in the form of compressible foam elements 960 attached to the flexible bag proximate to a one-way valve element 930. As described above, the flexible bag 900 includes overlapping first and second sidewalls 902, 904 that are joined along parallel first and second side edges 910, 912 and a perpendicular closed bottom edge 914 that define an internal volume 906. To access the internal volume 906, the portions of the first and second sidewalls 902, 904 opposite the closed bottom edge 914 remain unsealed to form an open top edge 916. To releasably close the open top edge 916 after insertion of an item, first and second fastening strips 920, 922 are provided.

The compressible foam elements 960 are shaped as rectangular blocks of porous foam attached to the inner surface of the first sidewall 902 on either side of valve element 930. However, in other embodiments, the foam elements can be attached to the second sidewall in a manner to align with the valve element. Additionally, in other embodiments, the foam element can have other shapes, such as circular, square, annular, or polygon. The foam elements 960 extend into the internal volume 906 and terminate at respective foam top surfaces 962 that are located closer toward the second sidewall 904 than the valve element 930. During evacuation, as the first and second sidewalls 902, 904 collapse towards each other, the second sidewall will contact the foam top surfaces 962 and begin to compress the foam blocks 960 towards the first sidewall 902. Conversely, the foam blocks 960 will urge the second sidewall 904 away from the valve element 930 preventing the valve element from clogging. Because of the porous character of the foam blocks 960, air will continue to have access to the valve element. Preferably, the foam blocks are formed from foamed rubber.

Figure 27:
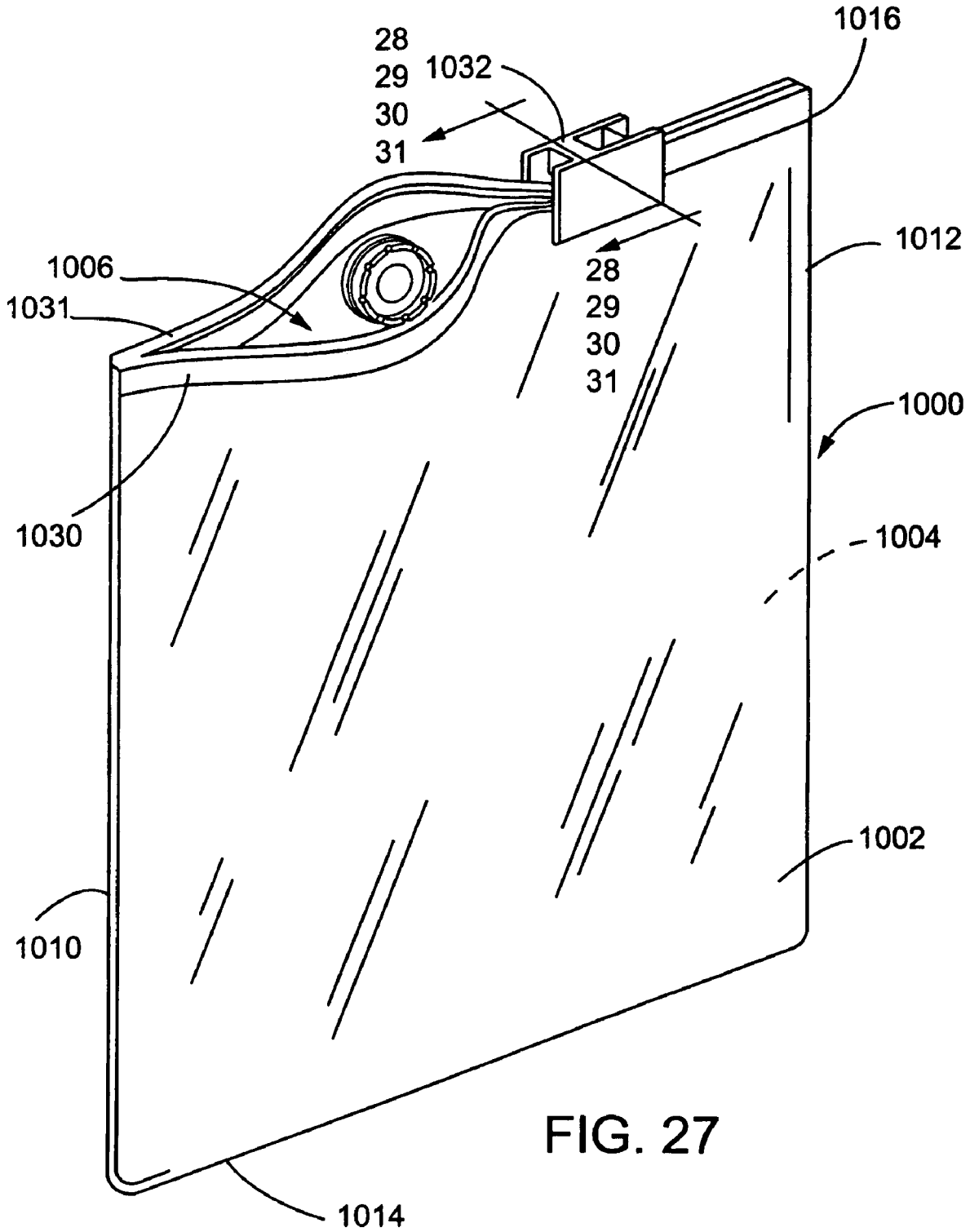
FIG. 27 is a perspective view of a flexible bag having a closable open top with interlocking fastener strips and a slider, a one-way valve element and an embodiment of the clearance member.

In another aspect of the invention, the flexible bag having a one-way valve element and clearance member can be provided with fastening strips activated by a slider. For example, referring to FIG. 27, there is illustrated a flexible bag 1000 having overlapping first and second sidewalls that are joined along parallel first and second side edges 1010, 1012, and a perpendicular closed bottom edge 1014 to define an internal volume 1006. To access the internal volume 1006, the portions of the first and second sidewalls 1002, 1004 that are opposite the closed bottom edge 1014 remain unjoined to form an open top edge 516. To releasably close the open top edge 1016, the flexible bag 1000 includes a first fastening strip 1030 and a second fastening strip 1031 that engage a movable slider 1032.

Figure 28:
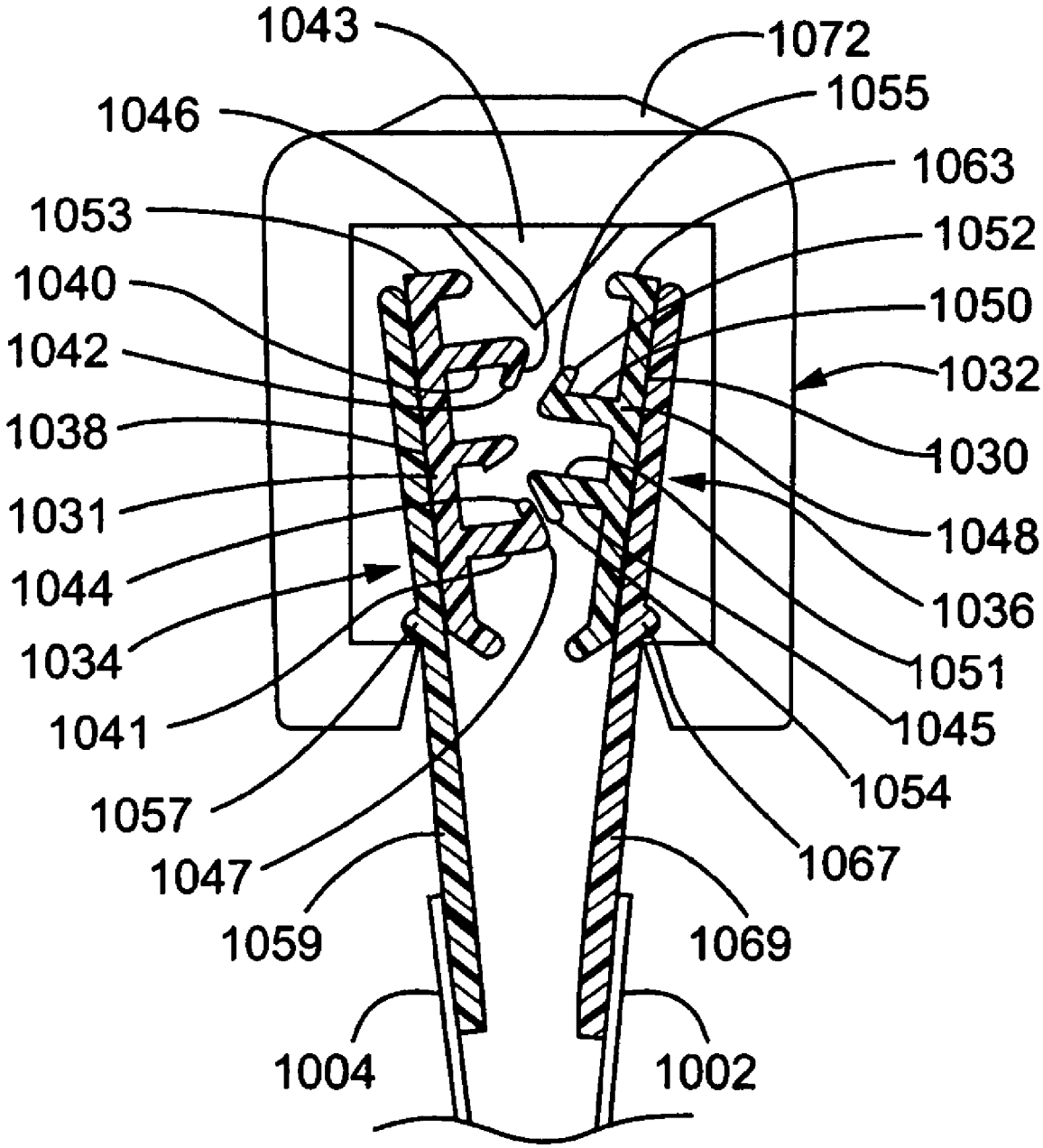
FIG. 28 is a cross-sectional view of the interlocking fasteners strips engaging a movable slider for releasably closing the opened top, as taken along line 28-28 of FIG. 27.

As shown in FIG. 28, the fastening strips may be U-channel fastening strips as described in U.S. Pat. No. 4,829,641, herein incorporated by reference in its entirety. U-channel fastening strips include a first fastening strip 1030 with a first closure element 1036 and a second fastening strip 1031 with a second closure element 1034. The first closure element 1036 engages the second closure element 1034. The first fastening strip 1030 may include a flange 1063 disposed at the upper end of the first fastening strip 1030 and a rib 1067 disposed at the lower end of the first fastening strip 1030. The first fastening strip 1030 may include a flange portion 1069. Likewise, the second fastening strip 1031 may include a flange 1053 disposed at the upper end of the second fastening strip 1031 and a rib 1057 disposed at the lower end of the second fastening strip 1031. The second fastening strip 1031 may include a flange portion 1059. The sidewalls 1002, 1004 of the plastic bag 1000 may be attached to the fastening strips 1030, 1031 by conventional manufacturing techniques.

The second closure element 1034 includes a base portion 1038 having a pair of spaced-apart parallely disposed webs 1040, 1041, extending from the base portion 1038. The base and the webs form a U-channel closure element. The webs 1040, include hook closure portions 1042, 1044 extending from the webs 1040, 1041 respectively, and facing towards each other. The hook closure portions 1042, 1044 include guide surfaces 1046, 1047 which serve to guide the hook closure portions 1042, 1044 for occluding with the hook closure portions 1052, 1054 of the first closure element 1036.

The first closure element 1036 includes a base portion 1048 including a pair of spaced-apart, parallely disposed webs 1050, 1051 extending from the base portion 1048. The base and the webs form a U-channel closure element. The webs 1050, 1051 include hook closure portions 1052, 1054 extending from the webs 1050, 1051 respectively and facing away from each other. The hook closure portions 1052, 1054 include guide surfaces 1045, 1055, which generally serve to guide the hook closure portions 1052, 1054 for occlusion with the hook closure portions 1042, 1044 of the second closure element 1034. The guide surfaces 1045, 1055 may also have a rounded crown surface.

Figure 11:
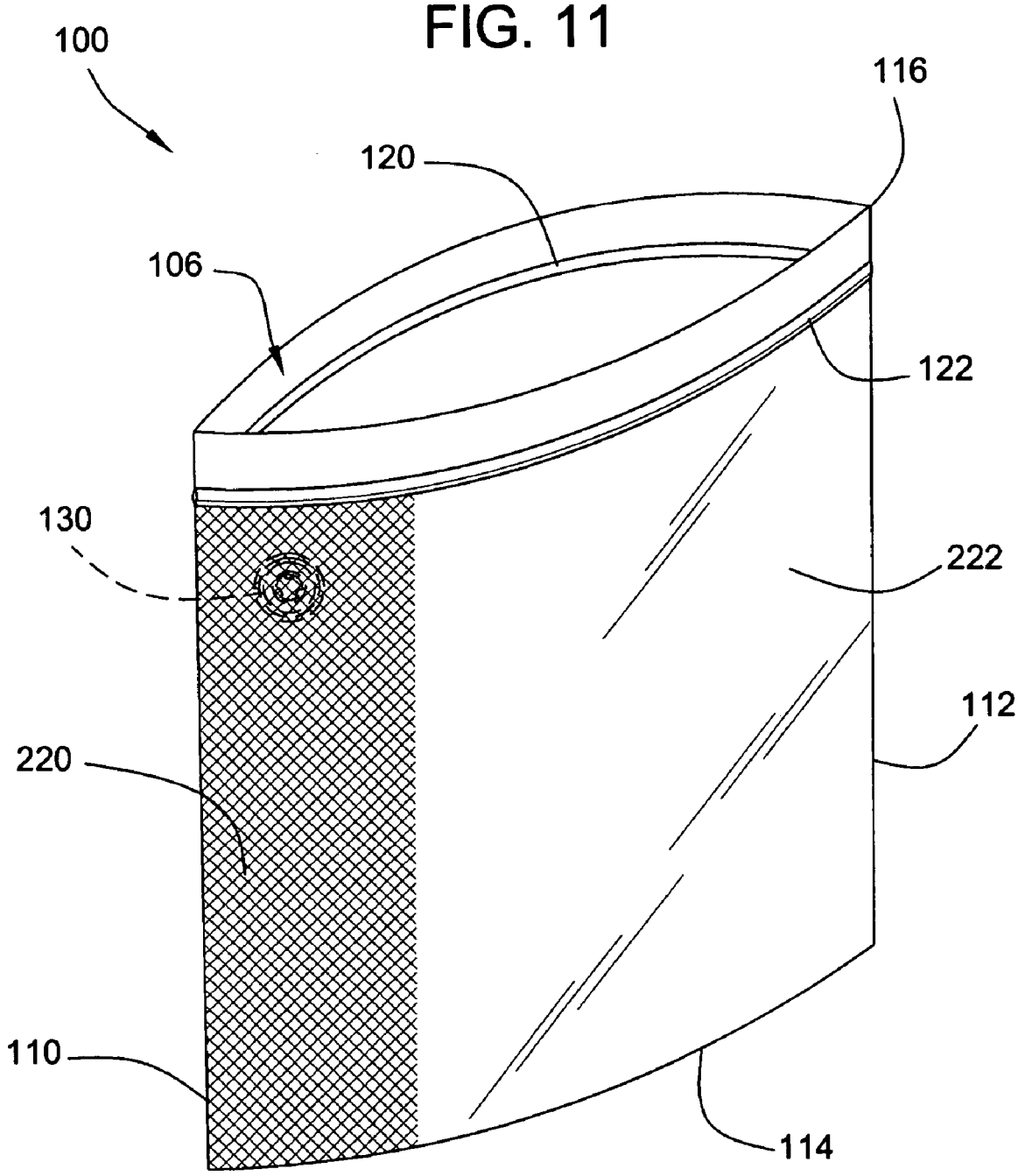
FIG. 11 is a perspective view of another embodiment of the flexible bag having an open top, a textured portion along a side edge, and a one-way valve element.
Figure 12:
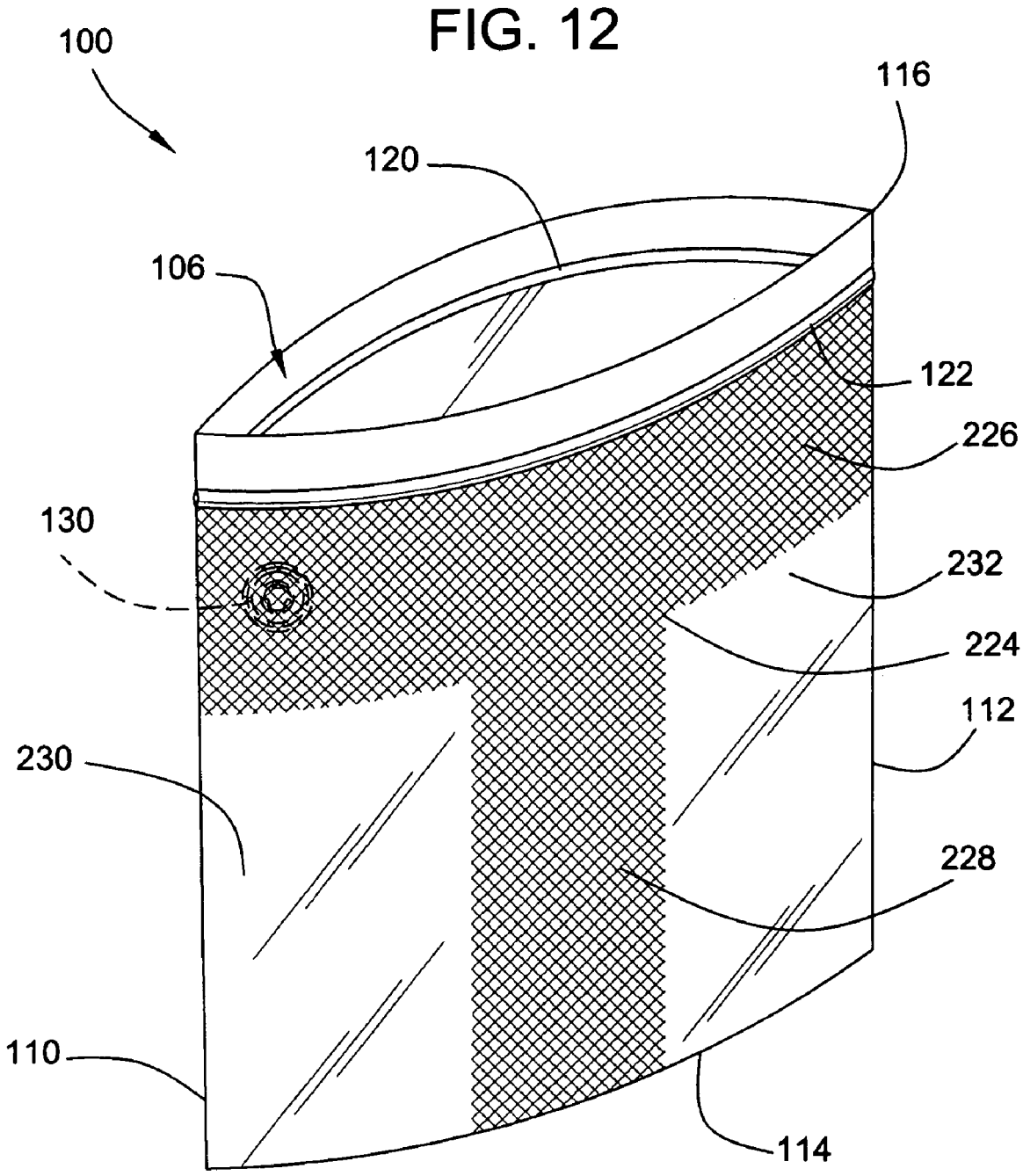
FIG. 12 is a perspective view of another embodiment of the flexible bag having an open top, a textured portion provided with a T-shape, and a one-way valve element.

The slider 1032 includes a top portion 1072. The top portion provides a separator 1043 having a first end and a second end wherein the first end may be wider than the second end. In addition, the separator 1043 may be triangular in shape. When the slider is moved in the occlusion direction, the separator 1043 deoccludes the fastening strips 1030, 1031 as shown in FIG. 11. Referring to FIG. 11, the closure elements 1034, 1036 are deoccluded and specifically, the upper hook portions 1042, 1052 and the lower hook portions 1044, 1054 are deoccluded.

Figure 29:
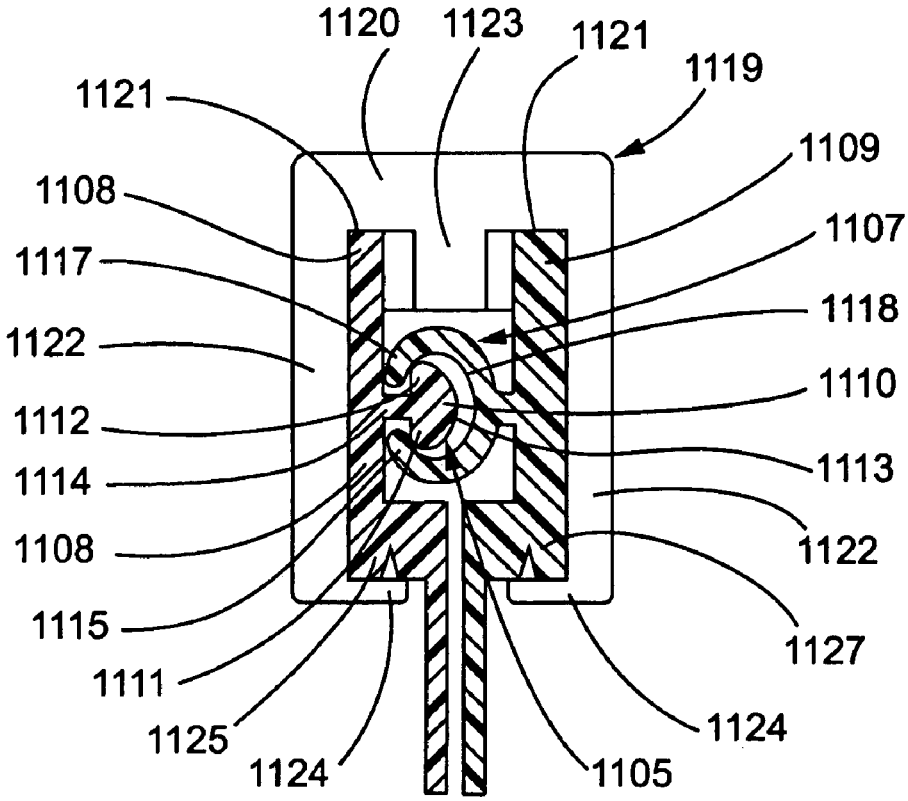
FIG. 29 is a cross-sectional view of another embodiment of the interlocking fastener strips engaging a movable slider for releasably closing the opened top, as taken along line 29-29 of FIG. 27.

The interlocking fastening strips may comprise "arrowhead-type" or "rib and groove" fastening strips as shown in FIG. 29 and as described in U.S. Pat. No. 3,806,998 herein incorporated by reference in its entirety. The rib element 1105 interlocks with the groove element 1107. The rib element 1105 is of generally arrow-shape in transverse cross section including a head 1110 comprising interlock shoulder hook portions 1111 and 1112 generally convergently related to provide a cam ridge 1113 generally aligned with a stem flange 1114 by which the head is connected in spaced relation with respect to the supporting flange portion 1108. (U.S. Pat. No. 3,806,998, Col. 2, lines 16-23). At their surfaces nearest the connecting stem flange 1114, the shoulder portions 1111 and 1112 define reentrant angles therewith providing interlock hooks engageable with interlock hook flanges 1115 and 1117 respectively of the groove element 1107. (U.S. Pat. No. 3,806,998, Col. 2, lines 23-28). Said hook flanges generally converge toward one another and are spread open to receive the head 1110 therebetween when said head is pressed into said groove element 1107 until the head is fully received in a groove 1118 of said groove element 1107 generally complementary to the head and within which the head is interlocked by interengagement of the head shoulder hook portions 1111 and 1112 and the groove hook flanges 1115 and 1117. (U.S. Pat. No. 3,806,998, Col. 2, lines 28-36). Through this arrangement, as indicated, the head and groove elements 1105 and 1107 are adapted to be interlockingly engaged by being pressed together and to be separated when forcably pulled apart, as by means of a generally U-shaped slider 1119. (U.S. Pat. No. 3,806,998, Col. 2, lines 36-41).

The slider 1119 includes a flat back plate 1120 adapted to run along free edges 1121 on the upper ends of the sections of the flange portions 1108 and 1109 as shown in the drawing. (U.S. Pat. No. 3,806,998, Col. 2, lines 41-46). Integrally formed with the back plate 1120 and extending in the same direction (downwardly as shown) therefrom are respective coextensive sidewalls 1122 with an intermediate spreader finger 1123 extending in the same direction as the sidewalls at one end of the slider. (U.S. Pat. No. 3,806,998, Col. 2, lines 46-51). The sidewalls 1122 are in the form of panels which are laterally divergent from a narrower end of the slider. (U.S. Pat. No. 3,806,998, Col. 2, lines 51-55). The slider walls 1122 are each provided with an inwardly projecting shoulder structure 1124 flange adapted to engage respective shoulder ribs 1125 and 1127 on respectively outer sides of the lower section of the flange portions 1108 and 1109. (U.S. Pat. No. 3,806,998, Col. 2, line 66 to Col. 3, line 3).

Figure 30:
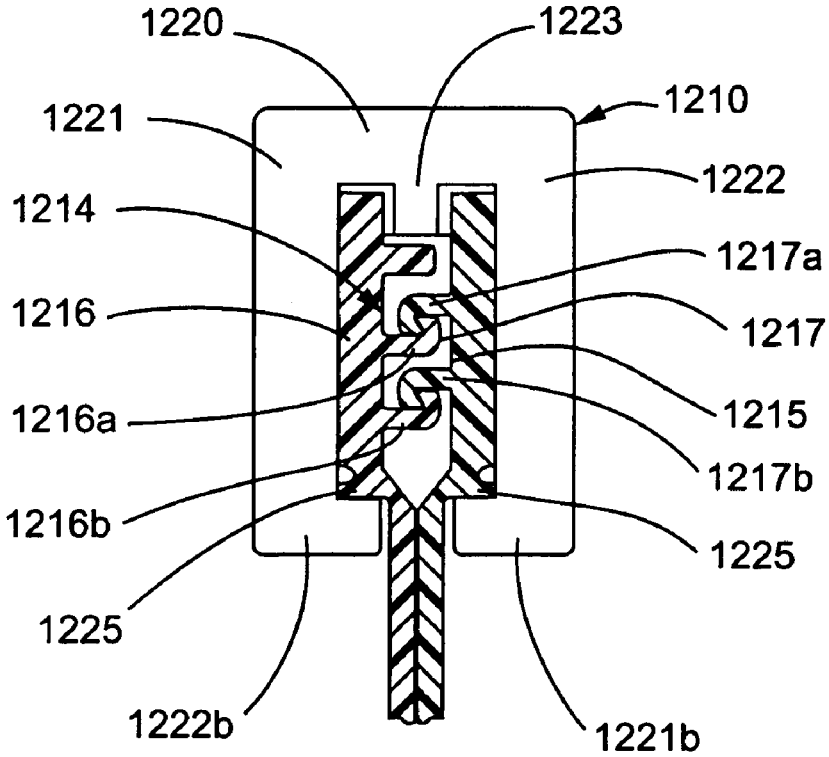
FIG. 30 is a cross-sectional view of another embodiment of the interlocking fastener strips engaging a movable slider for releasably closing the opened top, as taken along line 30-30 of FIG. 27.

Additionally, the interlocking fastening strips may comprise "profile" fastening strips, as shown in FIG. 30 and described in U.S. Pat. No. 5,664,299 herein incorporated by reference in its entirety. As shown in FIG. 30, the first profile 1216 has at least an uppermost closure element 1216*a* and a bottommost closure element 1216*b*. (U.S. Pat. No. 5,664,299, Col. 3, lines 25-27). The closure elements 1216*a* and 1216*b* project laterally from the inner surface of strip 1214. (U.S. Pat. No. 5,664,299, Col. 3, lines 27-28). Likewise, the second profile 1217 has at least an uppermost closure element 1217*a* and a bottommost closure element 1217*b*. (U.S. Pat. No. 5,664,299, Col. 3, lines 28-30). The closure elements 1217*a* and 1217*b* project laterally from the inner surface of strip 1215. (U.S. Pat. No. 5,664,299, Col. 3, lines 30-32). When the bag is closed, the closure elements of profile 1216 interlock with the corresponding closure elements of profile 1217. (U.S. Pat. No. 5,664,299, Col. 3, lines 32-34). As shown in FIG. 13, closure elements 1216*a*, 1216*b*, 1217*a* and 1217*b* have hooks on the ends of the closure elements, so that the profiles remain interlocked when the bag is closed, thereby forming a seal. (U.S. Pat. No. 5,664,299, Col. 3, lines 34-37).

The straddling slider 1210 comprises an inverted U-shaped member having a top 1220 for moving along the top edges of the strips 1214 and 1215. (U.S. Pat. No. 5,664,299, Col. 4, lines 1-3). The slider 1210 has sidewalls 1221 and 1222 depending from the top 1220. (U.S. Pat. No. 5,664,299, Col. 4, lines 3-4). A separating leg 1223 depends from the top 1220 between the sidewalls 1221 and 1222 and is located between the uppermost closure elements 1216*a* and 1217*a* of profiles 1216 and 1217. (U.S. Pat. No. 5,664,299, Col. 4, lines 26-30). The fastening assembly includes ridges 1225 on the outer surfaces of the fastening strips 1214 and 1215, and shoulders 1221*b* and 1222*b* on the sidewalls of the slider. (U.S. Pat. No. 5,664,299, Col. 4, lines 62-65). The shoulders act as means for maintaining the slider in straddling relation with the fastening strips by grasping the lower surfaces of the ridges 1225. (U.S. Pat. No. 5,664,299, Col. 5, lines 4-7).

Figure 31:
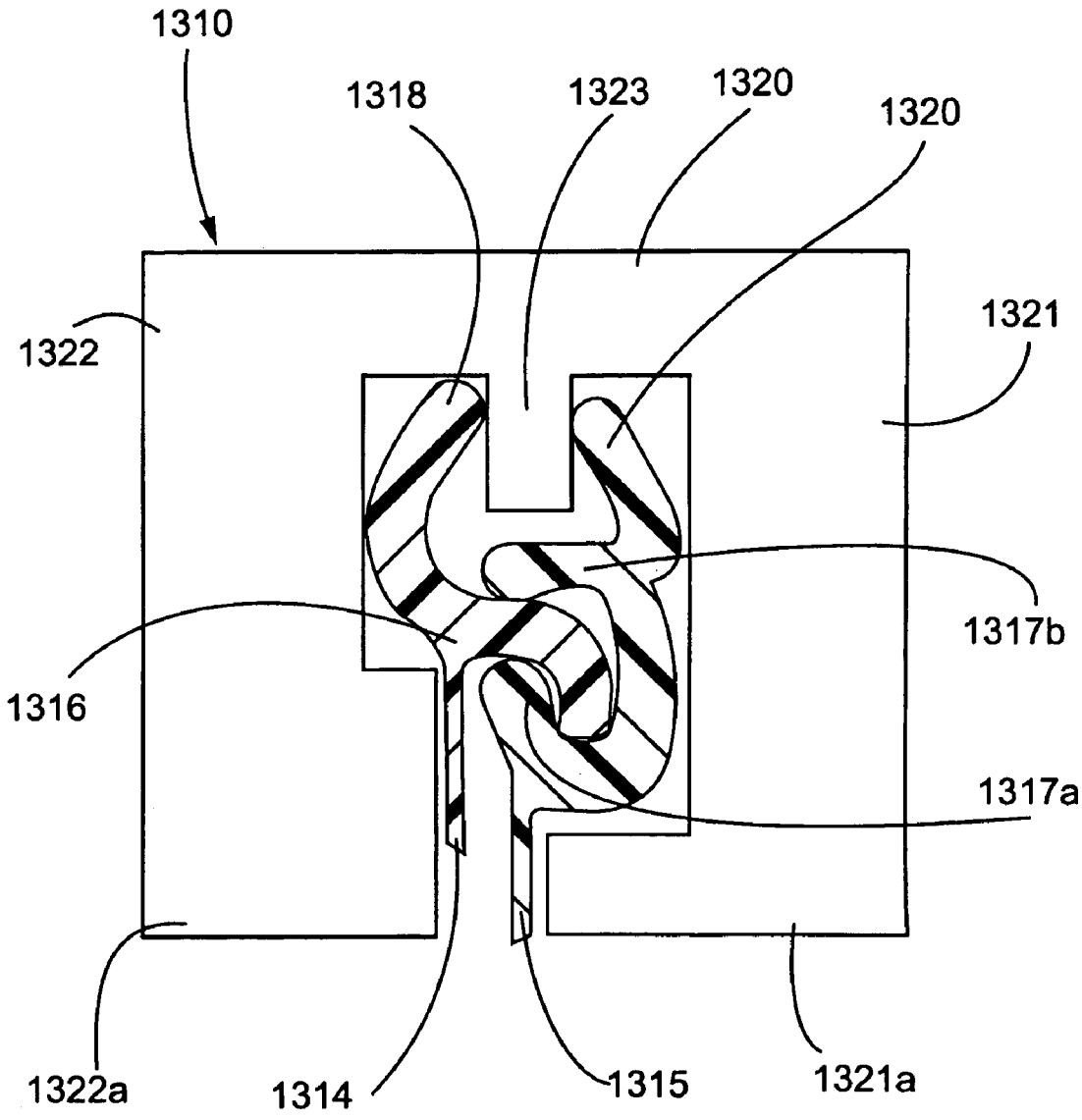
FIG. 31 is a cross-sectional view of another embodiment of the interlocking fastener strips engaging a movable slider for releasably closing the opened top, as taken along line 31-31 of FIG. 27.

Also, the interlocking fastening strips may be "rolling action" fastening strips as shown in FIG. 31 and described in U.S. Pat. No. 5,007,143 herein incorporated by reference in its entirety. The strips 1314 and 1315 include profiled tracks 1318 and 1319 extending along the length thereof parallel to the rib and groove elements 1316 and 1317 and the rib and groove elements 1316, 1317 have complimentary cross-sectional shapes such that they are closed by pressing the bottom of the elements together first and then rolling the elements to a closed position toward the top thereof (U.S. Pat. No. 5,007,143, Col. 4, line 62 to Col. 5, line 1). The rib element 1316 is hook shaped and projects from the inner face of strip 1314. (U.S. Pat. No. 5,007,143, Col. 5, lines 1-3). The groove element 1317 includes a lower hook-shaped projection 1317*a* and a relatively straight projection 1317*b* which extend from the inner face of strip 1315. (U.S. Pat. No. 5,007,143, Col. 5, lines 3-6). The profiled tracks 1318 and 1319 are inclined inwardly toward each other from their respective strips 1314 and 1315. (U.S. Pat. No. 5,007,143, Col. 5, lines 6-8).

The straddling slider 1310 comprises an inverted U-shaped plastic member having a back 1320 for moving along the top edges of the tracks 1318 and 1319 with sidewalls 1321 and 1322 depending therefrom for cooperating with the tracks and extending from an opening end of the slider to a closing end. (U.S. Pat. No. 5,007,143, Col. 5, lines 26-31). A separator finger 1323 depends from the back 1320 between the sidewalls 1321 and 1322 and is inserted between the inclined tracks 1318 and 1319. (U.S. Pat. No. 5,007,143, Col. 5, lines 34-36). The slider 1310 has shoulders 1321*a* and 1322*a* projecting inwardly from the depending sidewalls 1321 and 1322 which are shaped throughout the length thereof for cooperation with the depending separator finger 1323 in creating the rolling action in opening and closing the reclosable interlocking rib and groove profile elements 1316 and 1317. (U.S. Pat. No. 5,007,143, Col. 5, lines 43-49).

In other embodiments, the fastening strips noted above may also be used without the slider.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bag comprising:

a first sidewall;

a second sidewall overlaying the first sidewall to define an internal volume between the opposing first and second inner surfaces of the respective first and second sidewalls;

first and second interlocking closure strips attached respectively to the first and second sidewalls;

a one-way valve element attached to the first sidewall and communicating with the internal volume;

a permeable element located in the internal volume proximate the one-way valve element; and wherein the permeable element is solely attached to the second inner surface spaced from and opposite the valve element.

2. The bag of claim 1, wherein the permeable element is selected from the group consisting of nonwoven materials, woven fabrics, open cell foam, sponges, meshes or cellulosics.

3. The bag of claim 1, wherein the permeable element is hydrophobic.

4. A bag comprising:

a first side wall;

a second sidewall overlaying the first sidewall to define an internal volume between the opposing first and second inner surfaces of the respective first and second sidewalls;

a one-way valve element attached to the first sidewall and communicating with the internal volume;

a compressible clearance member located in the internal volume for providing a clearance between the second sidewall and the one-way valve element; and wherein the compressible clearance member is a helical spring.

5. The bag of claim 4, wherein the spring adhesively engages the valve element.

6. A bag comprising:

a first side wall;

a second sidewall overlaying the first sidewall to define an internal volume between the opposing first and second inner surfaces of the respective first and second sidewalls;

a one-way valve element attached to the first sidewall and communicating with the internal volume;

a compressible clearance member located in the internal volume for providing a clearance between the second sidewall and the one-way valve element; and wherein the compressible clearance member is a first and a second compressible foam element, the first and second compressible foam elements each having a rectangular shape, the first and second compressible foam elements attached to the first sidewall on opposite sides of the valve element.

* * * * *